US009610795B2

(12) United States Patent
Sato

(10) Patent No.: US 9,610,795 B2
(45) Date of Patent: Apr. 4, 2017

(54) BINDING DEVICE AND IMAGE FORMING APPARATUS FOR BINDING SHEET BUNDLE

(71) Applicant: FUJI XEROX CO., LTD., Tokyo (JP)

(72) Inventor: Ryuichi Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 90 days.

(21) Appl. No.: 14/691,626

(22) Filed: Apr. 21, 2015

(65) Prior Publication Data

US 2016/0009116 A1 Jan. 14, 2016

(30) Foreign Application Priority Data

Jul. 9, 2014 (JP) ..... 2014-141101

(51) Int. Cl.

| | |
|---|---|
| ***B65H 37/04*** | (2006.01) |
| ***B42B 4/00*** | (2006.01) |
| ***B42C 1/12*** | (2006.01) |
| ***G03G 15/00*** | (2006.01) |
| ***B27F 7/21*** | (2006.01) |
| ***B27F 7/36*** | (2006.01) |

(52) U.S. Cl.

CPC ..... *B42B 4/00* (2013.01); *B27F 7/21* (2013.01); *B27F 7/36* (2013.01); *B42C 1/12* (2013.01); *B65H 37/04* (2013.01); *G03G 15/5004* (2013.01); *G03G 15/6544* (2013.01); *B65H 2408/122* (2013.01); *B65H 2801/27* (2013.01)

(58) Field of Classification Search

CPC .. B65H 37/04; B42B 4/00; B27F 7/21; B42C 1/12; G03G 15/5004; G03G 15/6544

USPC ..... 270/58.08, 58.09; 399/410; 227/2

See application file for complete search history.

(56) References Cited

U.S. PATENT DOCUMENTS

| | | | | |
|---|---|---|---|---|
| 5,354,042 | A * | 10/1994 | Coombs | B27F 7/36 227/5 |
| 7,240,898 | B2 | 7/2007 | Takamura et al. | |
| 7,575,229 | B2 * | 8/2009 | Kushida | B42B 4/00 270/58.08 |
| 8,280,299 | B2 | 10/2012 | Achiwa | |
| 9,248,581 | B2 * | 2/2016 | Misumi | B27F 7/36 |

(Continued)

FOREIGN PATENT DOCUMENTS

| | | | |
|---|---|---|---|
| JP | 4-348995 | A | 12/1992 |
| JP | 2001-142268 | A | 5/2001 |

(Continued)

*Primary Examiner* — Patrick Mackey

(74) *Attorney, Agent, or Firm* — Sughrue Mion, PLLC

(57) ABSTRACT

A binding device includes a sheet-bundle forming unit; a binding unit that executes a series of operation including inserting a wire into a sheet bundle and bending the wire; a power supply unit; a detector that detects a first timing for transitioning from bending operation to recovery operation; a first timekeeper that measures time from a start point of the series of operation to a first time point, which is an end of a scheduled first-timing detection period; a unit-of-processing manager; and a supply power controller. When the first time point is reached before detection of the first timing, the controller causes the power supply unit to adjust the electric power before the first timing is reached, such that the first timing is detected before the first time point in the series of operation for a second bundle belonging to the same unit of processing as a first bundle.

6 Claims, 21 Drawing Sheets

(56) References Cited

U.S. PATENT DOCUMENTS

| | | | | |
|---|---|---|---|---|
| 2015/0203310 | A1* | 7/2015 | Yamazaki | B65H 37/04 399/408 |
| 2015/0205243 | A1* | 7/2015 | Yamazaki | B31F 5/02 399/408 |
| 2015/0368062 | A1* | 12/2015 | Saito | B65H 37/04 270/58.08 |

FOREIGN PATENT DOCUMENTS

| | | | | |
|---|---|---|---|---|
| JP | 2005-206374 | A | | 8/2005 |
| JP | 2010-13203 | A | | 1/2010 |
| JP | 2011-201689 | A | | 10/2011 |
| JP | 2011-203607 | A | | 10/2011 |
| JP | 2011201687 | A | * | 10/2011 |

* cited by examiner

FIG. 22

| MODE | TABLE |
|---|---|
| SIMPLEX | TABLE 1 |
| DUPLEX | TABLE 2 |

FIG. 23

| | | NUMBER OF SHEETS TO BE STAPLED | | | | |
|---|---|---|---|---|---|---|
| | | 2 TO 20 | 21 TO 50 | 51 TO 100 | 101 TO 150 | 151 TO 200 |
| SHEET TYPE | THIN PAPER | A | A | B | B | C |
| | PLAIN PAPER 1 | A | B | B | C | C |
| | PLAIN PAPER 2 | B | B | C | C | C |
| | THICK PAPER | B | C | C | C | C |
| | COATED PAPER | C | C | C | C | C |
| | THICK PAPER 2 | C | C | C | C | C |

FIG. 24A

| TABLE 1 | START DUTY CYCLE | RECOVERY DUTY CYCLE |
|---|---|---|
| GROUP A | 40% | 80% |
| GROUP B | 60% | 90% |
| GROUP C | 80% | 100% |

FIG. 24B

| TABLE 2 | START DUTY CYCLE | RECOVERY DUTY CYCLE |
|---|---|---|
| GROUP A | 50% | 60% |
| GROUP B | 70% | 80% |
| GROUP C | 90% | 100% |

FIG. 25A

| |
|---|
| START DUTY CYCLE (40%) |
| RECOVERY DUTY CYCLE (80%) |

FIG. 25B

| |
|---|
| SENSOR FLAG |

BINDING DEVICE AND IMAGE FORMING APPARATUS FOR BINDING SHEET BUNDLE

CROSS-REFERENCE TO RELATED APPLICATIONS

This application is based on and claims priority under 35 USC 119 from Japanese Patent Application No. 2014-141101 filed Jul. 9, 2014.

BACKGROUND

Technical Field

The present invention relates to binding devices and image forming apparatuses.

SUMMARY

According to an aspect of the invention, there is provided a binding device including a sheet-bundle forming unit, a binding unit, a power supply unit, a detector, a first timekeeper, a unit-of-processing manager, and a supply power controller. The sheet-bundle forming unit forms a sheet bundle by receiving and stacking multiple sheets. The binding unit includes a motor and executes a series of operation including inserting opposite ends of a substantially U-shaped bent wire into the sheet bundle by utilizing a driving force from the motor, and bending the opposite ends. The power supply unit adjusts electric power and supplies the adjusted electric power to the motor. Based on a rotational amount of the motor, the detector detects a first timing for transitioning from bending operation for bending the opposite ends of the wire that have pierced the sheet bundle to recovery operation for recovering to an initial position upon completion of the bending operation. The first timekeeper measures time from a start point of the series of operation to a first time point, which is an end point of a scheduled period for detecting the first timing. The unit-of-processing manager manages a unit of processing. When the first time point measured by the first timekeeper is reached before the first timing is detected by the detector, the supply power controller causes the power supply unit to adjust the electric power supplied to the motor before the first timing is reached, such that the first timing is detected by the detector prior to reaching of the first time point measured by the first timekeeper in the series of operation for a second sheet bundle that is to undergo a subsequent series of operation belonging to the same unit of processing as a first sheet bundle undergoing a current series of operation. The supply power controller causes the power supply unit to increase the electric power supplied to the motor when the first time point measured by the first timekeeper is reached before the first timing is detected by the detector.

BRIEF DESCRIPTION OF THE DRAWINGS

An exemplary embodiment of the present invention will be described in detail based on the following figures, wherein:

FIG. 22 illustrates a correspondence relationship between modes and tables;

FIG. 23 illustrates a group table that classifies sheet bundles into groups based on the sheet type and the number of sheets;

FIGS. 24A and 24B illustrate the contents of two tables shown in FIG. 22;

FIGS. 25A and 25B each illustrate a working area within a RAM;

DETAILED DESCRIPTION

An exemplary embodiment of the present invention will be described below with reference to the drawings.

Figure 1:
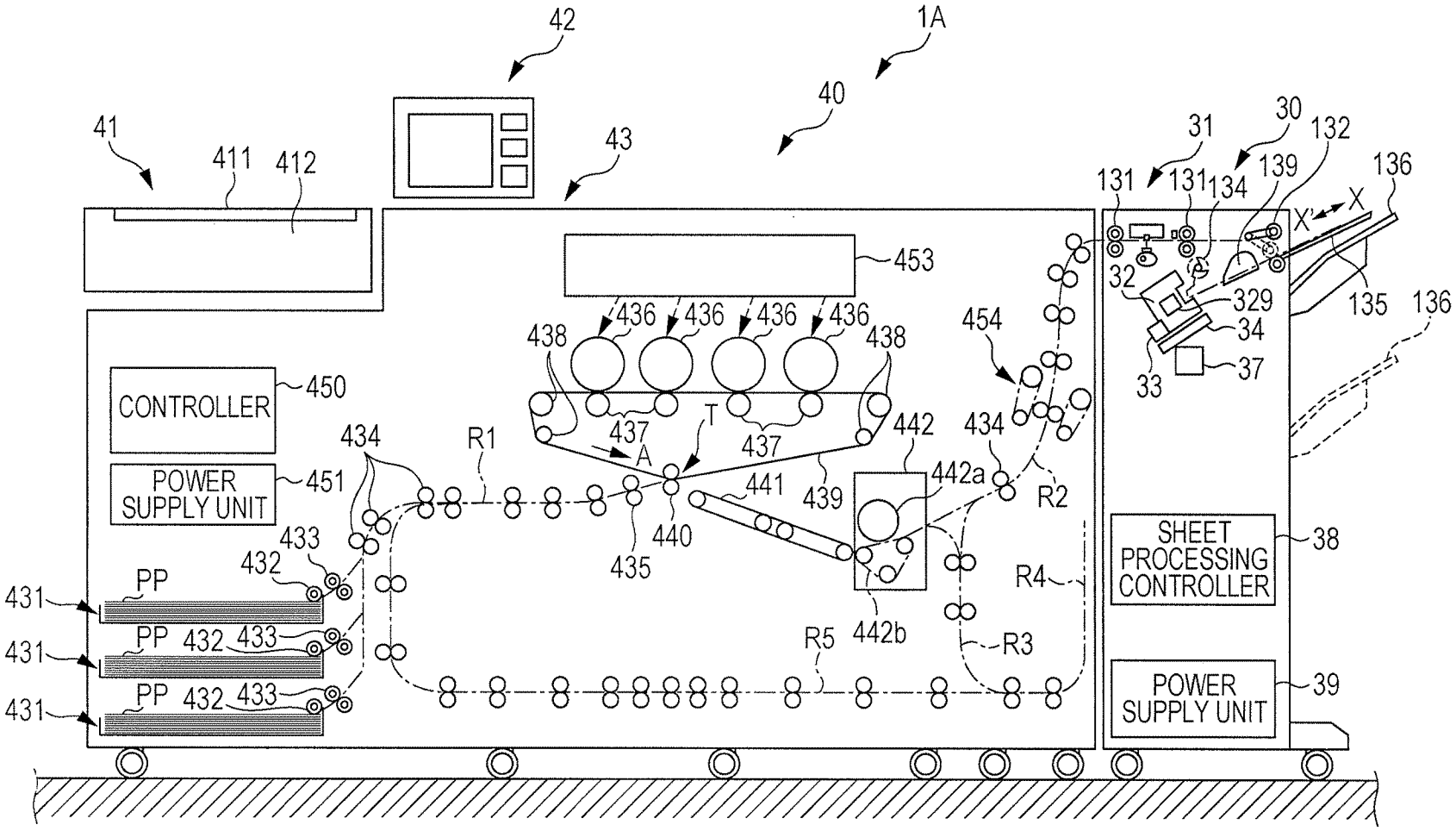
FIG. 1 illustrates the overall configuration of a print system.

FIG. 1 illustrates the overall configuration of a print system.

In FIG. 1, the overall configuration of a print system constituted by connecting a copier and a post-processing device is shown.

Specifically, a print system 1A is constituted of a copier 40 and a post-processing device 30.

The copier 40 shown in FIG. 1 includes an image reading unit 41, an operation panel 42, and an image forming unit 43. These units in the copier 40 each operate by being supplied with electric power from a power supply unit 451.

The image reading unit 41 includes a transparent document base 411 where a document image is read, and a body 412 that accommodates therein an optical scan system (not shown) constituted of, for example, a lamp and a mirror. A document is placed on the document base 411 such that a document image on the document comes into contact with the document base 411. The optical scan system scans the document image so as to read the document image. As a result, an image signal expressing the document image is generated. The generated image signal is accumulated into a memory within a controller 450.

The operation panel 42 accepts operation performed by a user. In this case, various kinds of operation, such as various kinds of settings, an image read start command, and an image formation start command, are performed. The various kinds of commands made via the operation panel 42 are also stored within the controller 450.

The image forming unit 43 is an electrophotographic printer that forms an image onto a sheet based on the image signal accumulated in the controller 450.

The image forming unit 43 is provided with three sheet accommodation sections 431. The sheet accommodation sections 431 accommodate sheets P of different types, different dimensions, and different orientations (i.e., vertical and horizontal orientations). Information regarding the types, dimensions, and orientations of the sheets P accommodated in the sheet accommodation sections 431 is set in advance by performing operation via the operation panel 42 and is stored in the controller 450. When a print command is received from the operation panel 42, a sheet P is fetched by a fetching roller 432 from one of the sheet accommodation sections 431 in accordance with the command. The fetched sheet P is transported along a sheet transport path R1 by a feed roller 433 and transport rollers 434 so that the leading edge of the sheet P reaches an adjustment roller 435.

An exposure unit 453 exposes photoconductors 436, which are disposed individually for cyan (C), magenta (M), yellow (Y), and black (K) colors, to light so as to form electrostatic latent images on the photoconductors 436. Developing units (not shown) develop the electrostatic latent images formed on the photoconductors 436 into toner images by using toners of the respective colors. Due to the function of transfer rollers 437, the toner images of the respective colors are transferred in a superimposed manner onto an intermediate transfer belt 439, which rotates in a direction indicated by an arrow A while being wrapped around support rollers 438.

The sheet P whose leading edge has reached the adjustment roller 435 is transported to a second-transfer position T in accordance with the timing of the toner images on the intermediate transfer belt 439. Due to the function of a second-transfer roller 440, the toner images on the intermediate transfer belt 439 become transferred onto the sheet P. The sheet P having the toner images transferred thereon is further transported by a transfer belt 441 and is heated and pressed by a fixing unit 442 constituted of a roller 442*a* and a belt 442*b* so that the toner images on the sheet P become fixed onto the sheet P, whereby a fixed image is formed on the sheet P. In a case of simplex printing, the sheet P after the fixing process travels along a sheet transport path R2 to a sheet correcting unit 454 where bending of the sheet P is corrected, and is further transported so as to be output from the copier 40. The sheet P output from the copier 40 is received by the post-processing device 30 connected to the subsequent stage of the copier 40. The copier 40 has a simplex printing mode in which printing is performed only on one face of the sheet P and a duplex printing mode in which printing is performed on both faces of the sheet P.

When the duplex printing mode is commanded, the sheet P having the image fixed on a first face thereof by the fixing unit 442 is transported along a sheet transport path R3 so as to reach a sheet transport path R4. Subsequently, the transport direction is reversed so that the sheet P travels along a sheet transport path R5 this time and then further travels along the sheet transport path R1. In this case, the front and rear faces of the sheet P have been inverted from when the sheet P fetched from the sheet accommodation section 431 travels along the sheet transport path R1. This time, an image is formed onto a second face of the sheet P traveling along the sheet transport paths R5 and R1 in a manner similar to the above. The sheet P then travels along the sheet transport path R2, is output from the copier 40, and is received by the post-processing device 30.

In the copier 40, a command is made by operating the operation panel 42 in a job-by-job fashion. Specifically, for example, a command for creating 10 bundles is input such that each bundle is to include 1 to 10 pages of copied images obtained by sequentially reading 10 document images using the image reading unit 41. For instance, in this example, sheets PP are sequentially fetched from one of the sheet accommodation sections 431 that accommodate the sheets PP in accordance with, for example, the dimensions of the images. Then, the sequentially-fetched sheets PP equivalent to a total of 10 bundles (i.e., 100 sheets) sequentially undergo printing in the following order: a first-page image, a second-page image, . . . , a tenth-page image, the first-page image, the second-page image, . . . , the tenth-page image, and so on. This example is described with reference to the simplex printing mode as an example. After the printing operation, the sheets are sequentially transported to the post-processing device 30.

In addition to storing image signals and storing commands made via the operation panel 42, the controller 450 performs overall control of the copier 40 as well as communication with the post-processing device 30 for information related to sheets transported to the post-processing device 30, which will be described in detail later. This information includes various kinds of information, such as information indicating whether or not to form punch holes in sheets constituting a current job, information indicating whether or not to execute stapling operation, information indicating how many sheets are to be stapled together per bundle if stapling operation is to be executed, information indicating whether or not a job identical to a previous sheet bundle is continuing, that is, whether or not the next sheet bundle to be formed has the same type of sheets and has the same number of sheets as the previous sheet bundle, and information indicating the positions of staples to be punched into the sheets if stapling operation is to be executed (e.g., one location at the upper left corner or two locations at the upper and lower positions along the left vertical edge). Information expressing a single job as a group of these various kinds of information will be referred to as "job information". The term "job" corresponds to an example of a unit of processing. A unit of processing is a unit of job expressed by a set of information, such as this job information, recognized as a single job by a binding device according to this exemplary embodiment. In this exemplary embodiment, a sheet bundle to be bound by a stapler 32 may be a single bundle alone or multiple successive bundles, depending on the unit of processing. Moreover, the controller 450 is also responsible for operational adjustment with respect to the post-processing device 30.

The copier 40 is also capable of receiving an image signal from a higher-level device instead of obtaining an image signal as a result of image reading performed by the image reading unit 41, or is also capable of receiving a command from the higher-level device instead of receiving a command via the operation panel 42. In this case, an image is formed onto a sheet P in accordance with a command from the higher-level device. The controller 450 is also responsible for communicating with this higher-level device.

The post-processing device 30 includes a puncher 31, a stapler 32, a sheet processing controller 38 that is responsible for controlling the operation of the puncher 31 and the stapler 32 and also for communicating with the copier 40, and a power supply unit 39 that is responsible for supplying electric power to each unit in the post-processing device 30. The stapler 32 corresponds to an example of a binding unit.

The stapler 32 is provided with a cutter 77 (see FIGS. 10 to 19 to be described later) that cuts off unwanted ends of a staple. The staple ends cut off by the cutter 77 become accommodated within an accommodation section 329 provided in the stapler 32. The stapler 32 is configured to move in accordance with a to-be-stapled position on a sheet bundle. When the stapler 32 moves to a predetermined staple-discarding position, the accommodation section 329 is opened. A staple collecting box 37 is provided below the accommodation section 329 of the stapler 32 that has moved to the staple-discarding position, and the staple ends temporarily accommodated in the accommodation section 329 are transferred to the staple collecting box 37. Statistically, this staple-discarding position is also a position where stapling operation for inserting a staple into a sheet bundle and bending the staple is executed most frequently. The staple collecting box 37 is detachable. The staple ends accumulated in the staple collecting box 37 are discarded by a user by detaching the staple collecting box 37.

A sheet taken into the post-processing device 30 is transported by a transport roller 131. If there is a command for forming a punch hole or holes near an edge of the sheet, the puncher 31 is activated. The sheet having the punch hole or holes formed therein is further transported so as to be output onto a sheet tray 136. The sheet tray 136 is vertically movable between a position indicated by a solid line and a position indicated by a dashed line in FIG. 1, such that the sheet tray 136 moves downward in accordance with the overall thickness of sheets sequentially stacked on the sheet tray 136.

If there is a command for binding a sheet bundle by using the stapler 32 equipped in the post-processing device 30, stapling operation using the stapler 32 is executed in the following manner.

Figure 2:
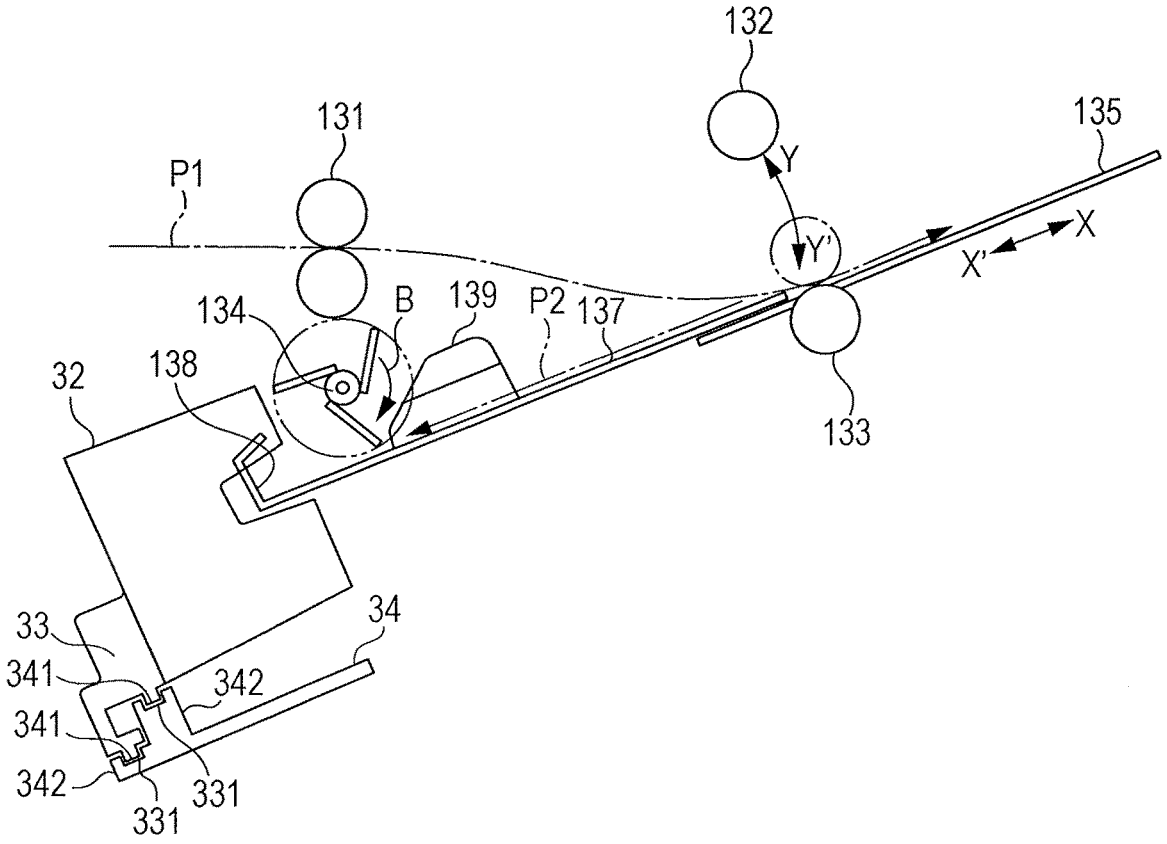
FIG. 2 illustrates the operation of a mechanism of and around a stapler of a post-processing device shown in FIG. 1.

FIG. 2 illustrates the operation of a mechanism of and around the stapler 32 of the post-processing device 30 shown in FIG. 1.

A stationary plate 137, onto which sheets are loadable, and a movable plate 135, which is movable in a direction indicated by an arrow X-X', are provided. In FIG. 2, the movable plate 135 is shown in a state where it has moved in the direction of the arrow X. Furthermore, a sheet output roller 132 and an opposing roller 133 are provided. The sheet output roller 132 is vertically movable in a direction indicated by an arrow Y-Y' shown in FIG. 2. When the sheet output roller 132 descends, the sheet output roller 132 and the opposing roller 133 nip the sheets therebetween and rotate so as to output the sheets onto the sheet tray 136 shown in FIG. 1. In this case, the sheet output roller 132 is shown in a state where it has ascended in the direction of the arrow Y. Furthermore, a paddler 134 and a side plate 139 are also provided. The paddler 134 rotates in a direction indicated by an arrow B so as to push the sheets toward the stapler 32. The sheets pushed toward the stapler 32 are brought into abutment with a stopper wall 138. A tapping plate (not shown) is disposed opposite the side plate 139 such that the tapping plate and the side plate 139 sandwich the sheets from left and right sides. The sheets transversely tapped by the tapping plate come into contact with the side plate 139, so that the side plate 139 aligns the transverse positions of the sheets.

A sheet that has passed through a region where the puncher 31 shown in FIG. 1 is disposed travels along a sheet transport path P1 shown in FIG. 2. In this case, the sheet output roller 132 has ascended in the direction of the arrow Y, and the movable plate 135 is in a state where it has moved in the direction of the arrow X. The sheet traveling along the sheet transport path P1 is placed astride the stationary plate 137 and the movable plate 135, is brought into abutment with the stopper wall 138 by the paddler 134, and is also brought into abutment with the side plate 139 by the tapping plate (not shown), whereby the sheet is positioned in both the longitudinal and transverse directions. The above-described operation is repeated while a predetermined number of sheets forming a single sheet bundle (10 sheets in the above example) are transported, whereby multiple sheets forming a single sheet bundle are stacked in a positionally aligned manner in the longitudinal and transverse directions. These multiple stacked sheets are bound into a single sheet bundle by the stapler 32. A leg portion 33 having two protrusions 331 is attached to the stapler 32. The two protrusions 331 of this leg portion 33 are fitted in grooves 341 that are formed in two rails 342 provided in a guide member 34 and extending in a direction orthogonal to the plane of FIG. 2. The stapler 32 is movable in the direction orthogonal to the plane of FIG. 2 by being guided by the two rails 342. Therefore, when binding a sheet bundle by using the stapler 32, the stapler 32 moves by being guided by the rails 342 so as to bind a designation location or locations of the sheet bundle, such as two locations near the middle or one location at a corner.

The stapling operation performed by the stapler 32 will be described later.

In synchronization with the binding of the sheet bundle by the stapler 32, the sheet output roller 132 descends in the direction of the arrow Y' so that the sheet output roller 132 and the opposing roller 133 nip the sheet bundle therebetween. Moreover, the movable plate 135 recedes in the direction of the arrow X'. When the binding operation performed on the sheet bundle is completed, the sheet output roller 132 rotates so as to output the sheet bundle onto the sheet tray 136.

In order to prevent a subsequent sheet from being transported from the copier 40 (see FIG. 1) during the above binding operation, the printing operation in the copier 40 is, for example, interrupted in accordance with adjustment between the copier 40 and the post-processing device 30. A long interruption time leads to lower productivity for printing and for creating sheet bundles. Therefore, although the stapling operation is desirably performed at high speed, high-speed stapling operation produces loud operating noise.

This exemplary embodiment is designed to ensure stable stapling operation while suppressing operating noise. Such design will be described later.

Figure 3:
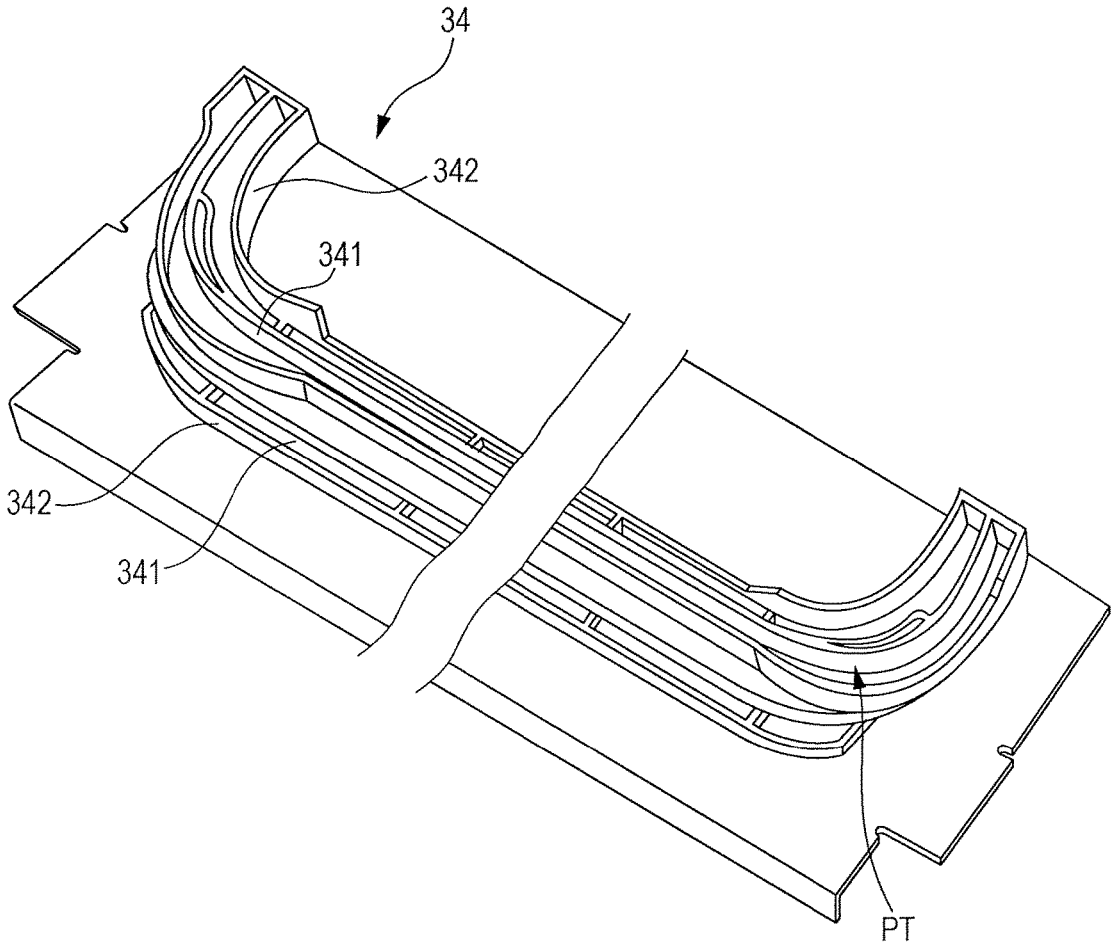
FIG. 3 is a perspective view illustrating a guide member provided with two rails.

FIG. 3 is a perspective view illustrating the guide member 34 provided with the two rails 342.

The two rails 342 of the guide member 34 are individually provided with the grooves 341. The protrusions 331 of the leg portion 33 shown in FIG. 2 are fitted in the grooves 341 so that the movement of the stapler 32 is guided. Although these rails 342 substantially extend in the direction orthogonal to the plane of FIG. 2, the rails 342 each have a curved shape near the opposite ends thereof. This is for binding the corners of the sheets at an angle relative to the sheets when binding the corners of the sheets.

The upper left corner of a sheet bundle is often bound at an angle relative to the sheets. Therefore, a staple-discarding position PT is set in an area where the rail frequently used for executing the stapling operation is curved. Thus, the number of staple ends temporarily accommodated in the accommodation section 329 of the stapler 32 may be reduced.

The post-processing device 30 described with reference to FIGS. 1 to 3 is connectable not only to the copier 40 of the type shown in FIG. 1, but also to a printer of another type. Moreover, the post-processing device 30 may be connectable to a printer based on another printing method, such as an inkjet printer, as an alternative to the electrophotographic method.

The post-processing device 30 corresponds to an example of a binding device. However, the exemplary embodiment of the present invention is also applicable to a post-processing device that does not have, for example, the puncher 31 and a controller for the puncher 31 in the post-processing device 30 and that performs stapling operation alone.

Next, the operation of the stapler 32 will be described.

Figure 4:
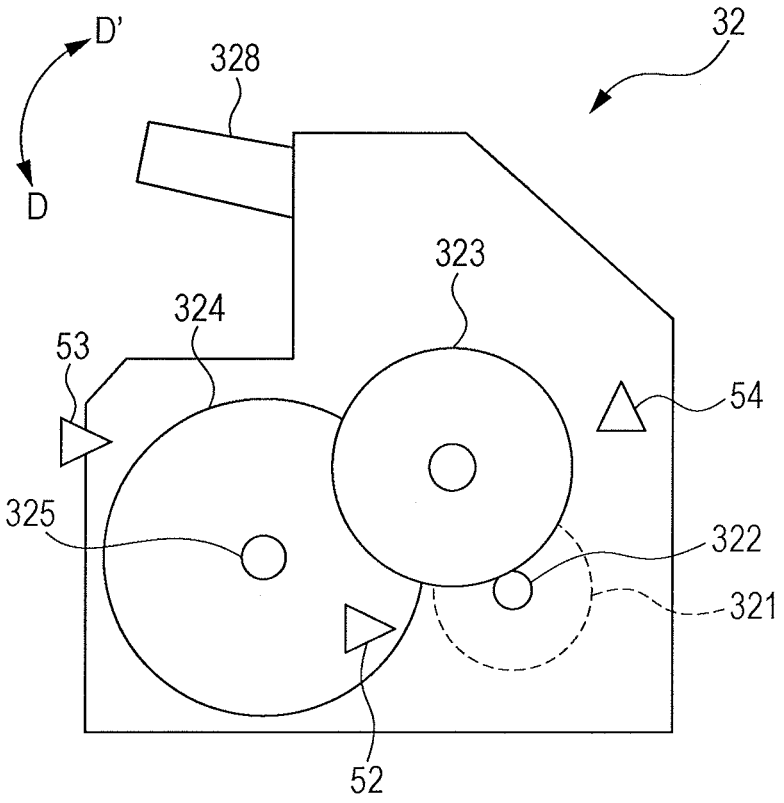
FIG. 4 schematically illustrates a driving-force transmission mechanism and a sensor of the stapler.

FIG. 4 schematically illustrates a driving-force transmission mechanism and a sensor of the stapler 32.

The stapler 32 has a pressing member 328. The stapler 32 is provided with a direct-current (DC) motor 321. When the DC motor 321 rotates, the pressing member 328 vertically moves in a direction indicated by an arrow D-D'. The DC motor 321 corresponds to an example of a motor as well as an example of a direct-current motor.

A driving-force transmission mechanism for transmitting a driving force from the DC motor 321 to the pressing member 328 is as follows. When the DC motor 321 rotates, a driving force is transmitted via a gear 322, an intermediate gear 323, and a drive gear 324 in this order, whereby a drive shaft 325 is rotated. After the following description with reference to FIGS. 5A to 6B, the description will proceed again by referring back to FIG. 4.

Figure 5A:
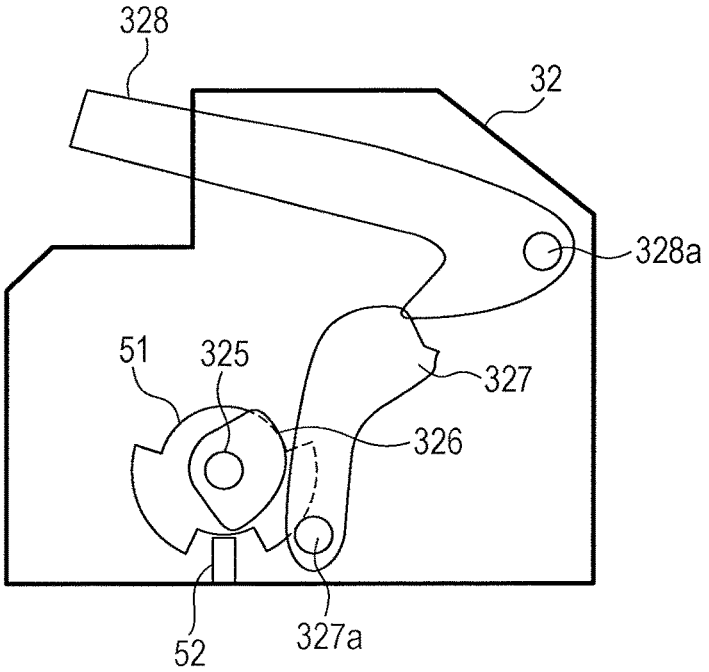
FIGS. 5A and 5B illustrate an operation mechanism of a pressing member provided in the stapler.
Figure 5B:
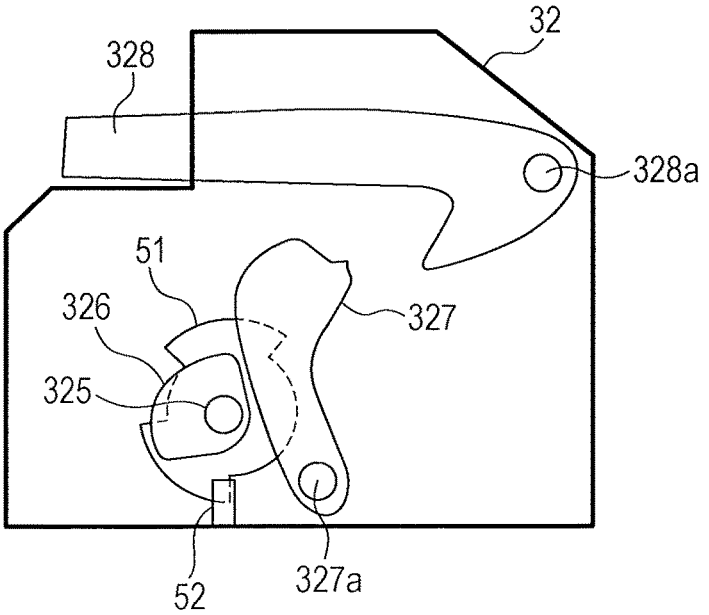

FIGS. 5A and 5B illustrate an operation mechanism of the pressing member 328 provided in the stapler 32.

The pressing member 328 rotates about a rotation axis 328*a* so as to vertically move between an upper position shown in FIG. 5A and a lower position shown in FIG. 5B. The drive shaft 325 has a drive cam 326 attached thereto and vertically moves the pressing member 328 via an intermediate cam 327 that rotates about a rotation axis 327*a*. When the drive shaft 325 makes one rotation, the pressing member 328 makes one lap, whereby one cycle of stapling operation is completed.

Furthermore, a light blocking plate 51 is attached to the drive shaft 325 at a position different from that of the drive cam 326 in an axial direction (i.e., a direction orthogonal to the plane of FIGS. 5A and 5B). The light blocking plate 51 is fixed to the drive shaft 325 and rotates in synchronization with the rotation of the drive cam 326 at the same speed and by the same rotational angle. Moreover, a motor-position (MP) sensor 52 is provided in the vicinity of the light blocking plate 51.

Figure 6A:
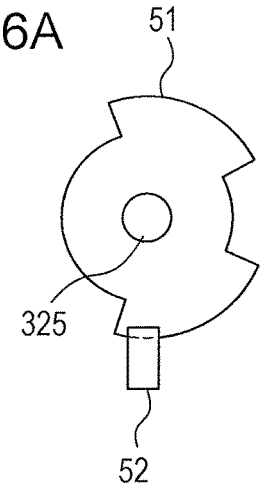
FIGS. 6A and 6B illustrate the positional relationship between a light blocking plate and an MP sensor.
Figure 6B:
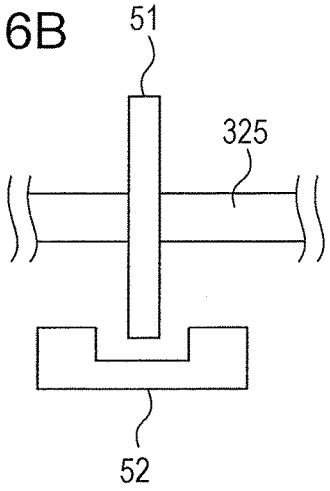

FIGS. 6A and 6B illustrate the positional relationship between the light blocking plate 51 and the MP sensor 52.

The MP sensor 52 is a photoelectric sensor that projects and receives light and is fixed at a position where the rotating light blocking plate 51 passes and blocks the light projected and received by the MP sensor 52. The MP sensor 52 outputs a low-level signal when the light blocking plate 51 passes by, and outputs a high-level signal when the light blocking plate 51 is not passing by the MP sensor 52. Because the light blocking plate 51 rotates together with the rotating drive shaft 325, the rotational position of the drive shaft 325 is detected by the MP sensor 52. In this case, the MP sensor 52 is used for detecting an initial position of the drive shaft 325 and also for detecting a clinching completion position, which will be described later. The MP sensor 52 corresponds to an example of a detector.

After causing the stapler 32 to start the stapling operation by supplying electric power to the DC motor 321, if the MP sensor 52 does not detect that the drive shaft 325 has made one rotation to the initial position after a certain threshold time period (e.g., 500 milliseconds), it is determined that the stapling operation is an error. In this case, the rotation of the DC motor 321 is stopped, and the DC motor 321 is rotated in the reverse direction. When the DC motor 321 is rotated in the reverse direction, the MP sensor 52 monitors whether or not the drive shaft 325 returns to the initial position within a certain threshold time period (e.g., 300 milliseconds). Although the processing contents vary depending on whether or not the MP sensor 52 detects that the drive shaft 325 has returned to the initial position within the certain threshold time period by reverse rotation of the DC motor 321, an error process is performed in either case.

The operation performed when the clinching completion position is detected by the MP sensor 52 will be described later.

Referring back to FIG. 4, various types of sensors equipped in the stapler 32 will now be described.

In addition to the MP sensor 52, the stapler 32 includes a sensor 53 and a sensor 54. The sensor 53 is configured to detect whether or not a staple (which will be described later) is in a state where the stapling operation for binding a sheet bundle is executable. The sensor 54 is configured to detect that the number of remaining staples is small.

Figure 7:
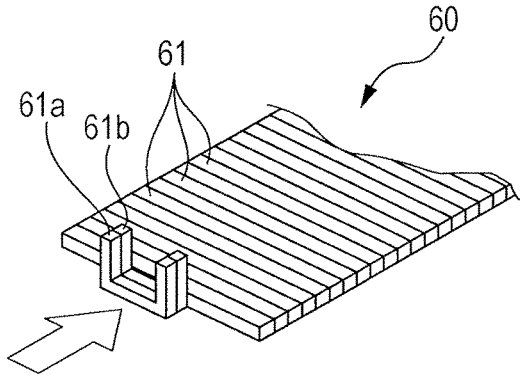
FIG. 7 illustrates the shape of staples.

FIG. 7 illustrates the shape of staples.

Specifically, staples 61 each have a linear shape. The linearly-shaped staples 61 are arranged in the form of a single plate and are bonded to one another so that the staples 61 are prevented from falling apart into pieces, whereby a staple plate 60 is formed. The staples 61 currently being used are first two staples 61*a* and 61*b*. Each of these staples 61*a* and 61*b* is bent into a substantially U-shape by bending the opposite ends thereof orthogonally relative to the staple plate 60. The staples 61 correspond to an example of wires.

Figure 8:
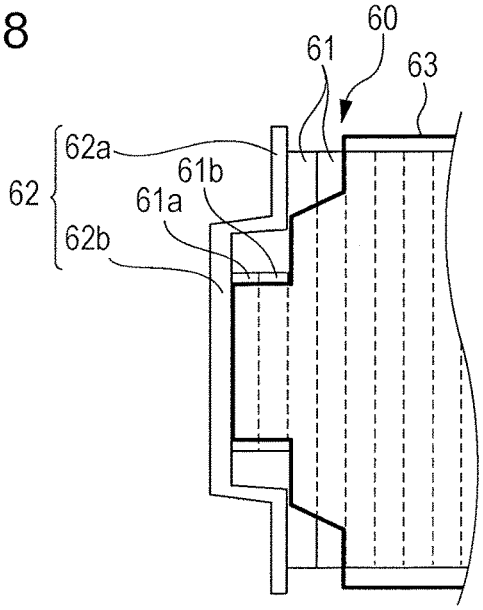
FIG. 8 is a plan view illustrating a state where a staple plate is brought into abutment with a staple stopper.

FIG. 8 is a plan view illustrating a state where the staple plate 60 is brought into abutment with a staple stopper 62.

The staple stopper 62 has a first stopper 62*a* with which the opposite ends of a non-yet-bent linearly-shaped staple 61 is brought into abutment, and a second stopper 62*b* with which the leading staple 61*a* of the first two bent staples 61*a* and 61*b* is brought into abutment. The staple plate 60 is covered with a guide member 63. An end portion of the guide member 63 has dimensions such that the end portion is fitted between the two bent staples 61*a* and 61*b*.

Figure 9A:
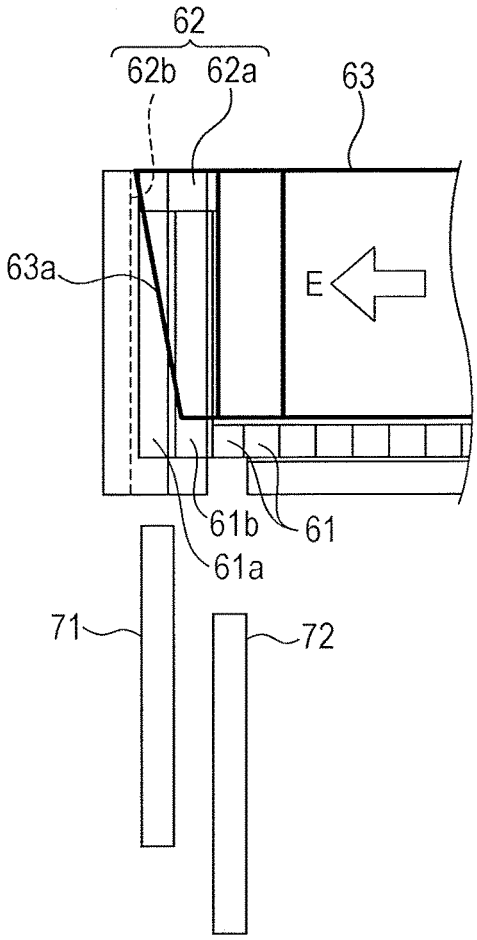
FIGS. 9A and 9B are side views illustrating a state where the staples are brought into abutment with the staple stopper.
Figure 9B:
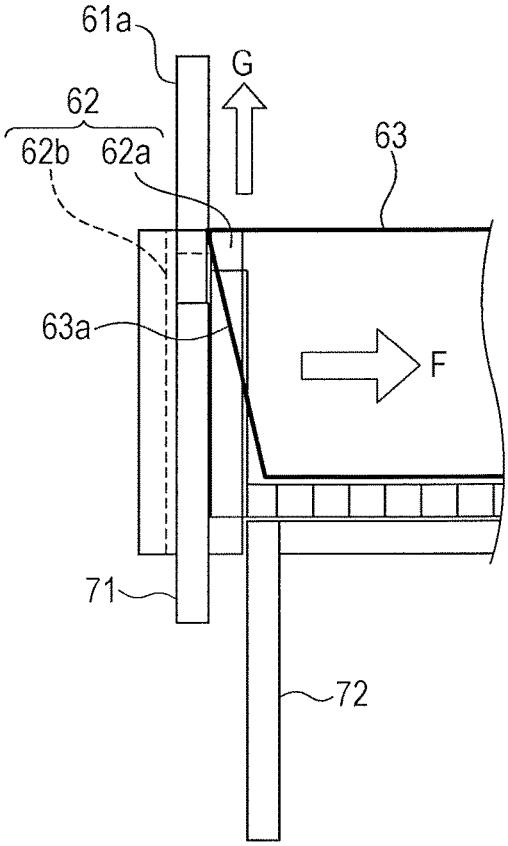

FIGS. 9A and 9B are side views illustrating a state where the staples 61 are brought into abutment with the staple stopper 62.

The guide member 63 has a slope 63*a* that covers an upper portion of the bent leading staple 61*a* and exposes a lower portion thereof. The guide member 63 is biased in a direction indicated by an arrow E in FIG. 9A by a spring (not shown).

The stapler 32 further includes a staple lifting member 71 having a thickness substantially equivalent to the width of one staple 61, and a staple bending member 72 having a similar thickness. The staple lifting member 71 is disposed directly below the bent leading staple 61*a*. The staple bending member 72 is disposed directly below the third staple 61 from the bent leading staple 61*a*, that is, directly below the non-yet-bent leading staple 61.

When the DC motor 321 (see FIG. 4) equipped in the stapler 32 rotates and causes the drive shaft 325 to rotate, the staple lifting member 71 lifts the leading staple 61*a* in a direction indicated by an arrow G so as to insert the staple 61*a* into a sheet bundle (not shown). During this lifting process, the guide member 63 is pushed back against the bias force of the spring in a direction indicated by an arrow F in FIG. 9B by a distance equivalent to one staple 61. Then, the staple bending member 72 ascending by following the staple lifted by the staple lifting member 71 bends the non-bent leading staple while using the end portion of the guide member 63 as a guide. When the operation for binding a single sheet bundle using the staple 61*a* lifted by the staple lifting member 71 is completed, the staple lifting member 71 and the staple bending member 72 descend to their initial positions shown in FIG. 9A.

FIGS. 10 to 19 illustrate the operation of the components in steps included in the stapling operation performed by the stapler 32.

As described above, the stapler 32 is equipped with the DC motor 321 (see FIG. 4). The DC motor 321 rotates and causes the drive shaft 325 to rotate. Due to this rotation of the drive shaft 325, the components involved in the stapling operation operate in cooperation with one another.

Figure 10:
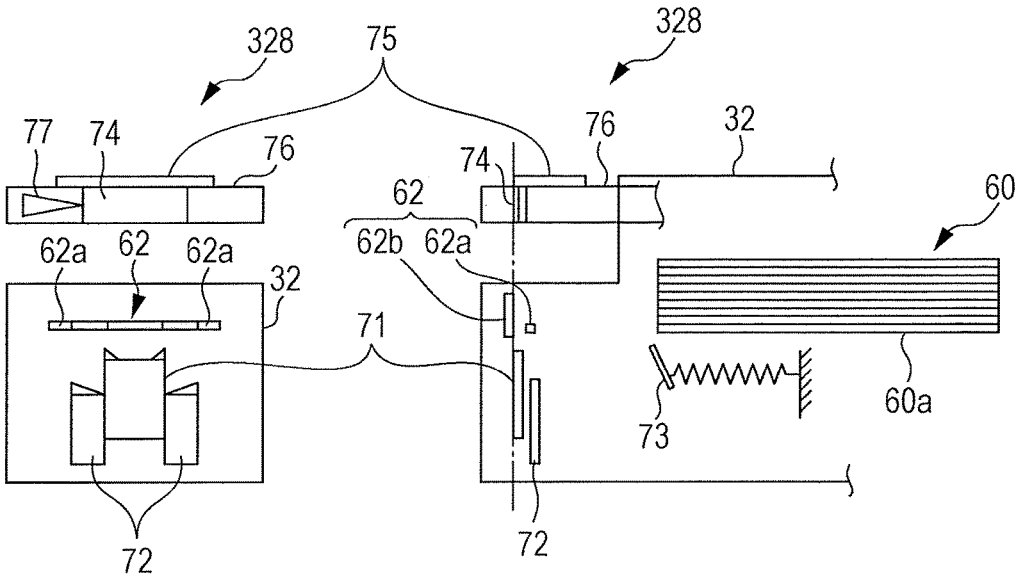
FIG. 10 illustrates the operation of components in a first step of stapling operation performed by the stapler.

FIG. 10 illustrates an initial state immediately after the staple plate 60 is loaded into the stapler 32. Specifically, multiple staple plates 60 are accommodated in a stacked manner. Furthermore, the staple stopper 62 constituted of the first stopper 62*a* and the second stopper 62*b* described above with reference to FIGS. 8 to 9B, the staple lifting member 71, the staple bending member 72, and a staple-feeding plate spring 73 are also shown. The plate spring 73 is responsible for feeding the lowermost staple plate 60*a* of the stacked staple plates 60 toward the staple stopper 62. Moreover, a staple bending member 74, a pressing member 75, an upper member 76, and the cutter 77, which are components constituting the pressing member 328 shown in, for example, FIG. 4, are also shown. The staple bending member 74 is responsible for bending the opposite ends of a staple that have pierced a sheet bundle and for pressing the opposite ends onto the sheet bundle. The pressing member 75 is responsible for pressing onto the staple bending member 74 from above. The upper member 76 is responsible for pressing onto a sheet bundle from above. The cutter 77 is responsible for cutting off excess ends of a staple, which are excess for binding a current sheet bundle.

Figure 11:
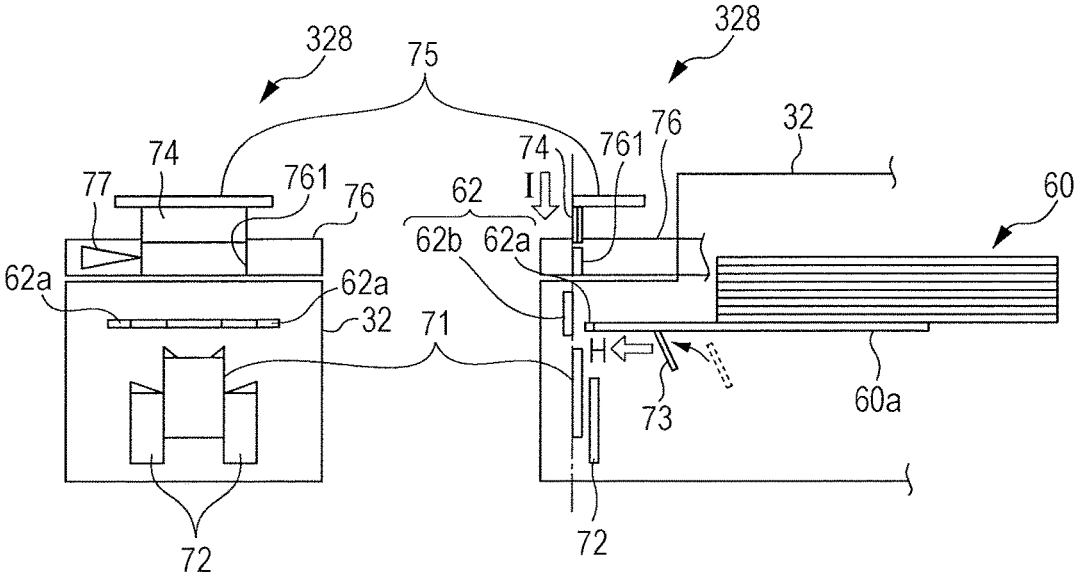
FIG. 11 illustrates the operation of the components in a second step of the stapling operation performed by the stapler.

FIG. 11 illustrates a step subsequent to the state shown in FIG. 10.

In FIG. 11, the staple plate 60*a* at the lowermost layer is moved by being pushed in a direction indicated by an arrow H by the plate spring 73 so that the opposite sides of the end of the staple plate 60*a* are brought into abutment with the first stopper 62*a*. Moreover, the upper member 76 has descended in a direction indicated by an arrow I while the staple bending member 74 and the pressing member 75 remain above. The upper member 76 has a recess 761 into which the staple bending member 74 fits. When the upper member 76 descends, the staple bending member 74 moves to a position relatively higher than the upper member 76, so that the recess 761 becomes exposed. The cutter 77 is supported by the upper member 76 and vertically moves together with the upper member 76 in accordance with the vertical movement thereof.

Figure 12:
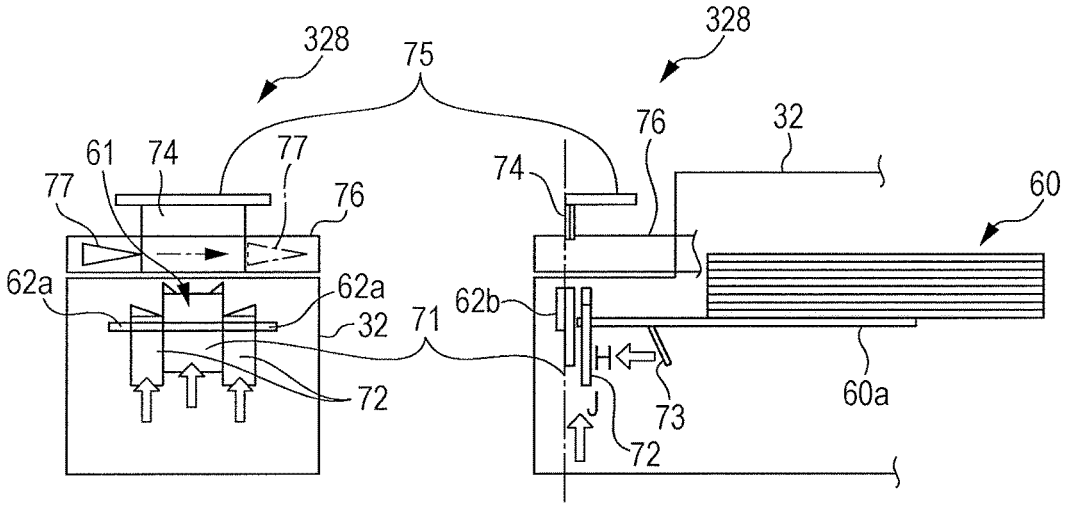
FIG. 12 illustrates the operation of the components in a third step of the stapling operation performed by the stapler.

Next, referring to FIG. 12, the staple lifting member 71 ascends in a direction indicated by an arrow J. However, at this stage, the staple 61*a* (see FIG. 8) in abutment with the second stopper 62*b* is not present, resulting in blank-lifting operation by the staple lifting member 71. As the staple lifting member 71 ascends, the staple bending member 72 also ascends, so that the opposite ends of the leading staple 61 in abutment with the first stopper 62*a* are bent orthogonally relative to the staple plate 60*a*. At this time, the plate spring 73 continues to bias the staple plate 60*a* in the direction of the arrow H.

Subsequently, the cutter 77 operates in accordance with an operation sequence. However, since there is no staple, this results in blank-cutting operation. After the operation, the cutter 77 returns to its initial position.

Subsequently, referring to FIG. 13, the pressing member 75 descends in a direction indicated by an arrow K so as to press the staple bending member 74 into the recess 761. However, since there is no staple present at this stage, this results in blank-pressing operation. The plate spring 73 temporarily moves rearward.

Subsequently, referring to FIG. 14, the upper member 76 ascends in a direction indicated by an arrow L together with the staple bending member 74 and the pressing member 75, and the staple lifting member 71 and the staple bending member 72 descend in a direction indicated by an arrow M. The staple plate 60*a* is pressed by the plate spring 73, so that the single bent leading staple 61*a* slides against the first stopper 62*a*, and the non-yet-bent second staple 61*b* is brought into abutment with the first stopper 62*a*.

Figure 14:
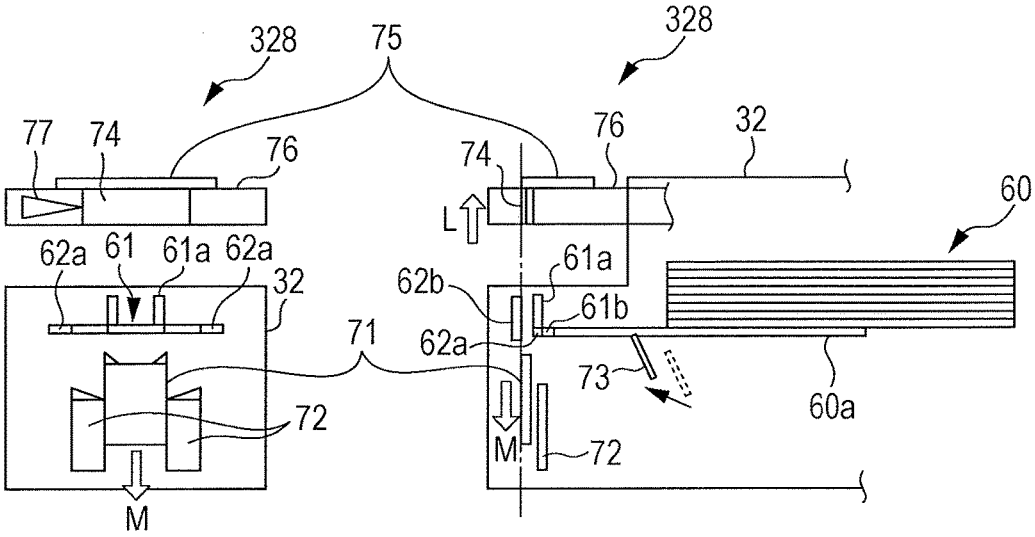
FIG. 14 illustrates the operation of the components in a fifth step of the stapling operation performed by the stapler.
Figure 15:
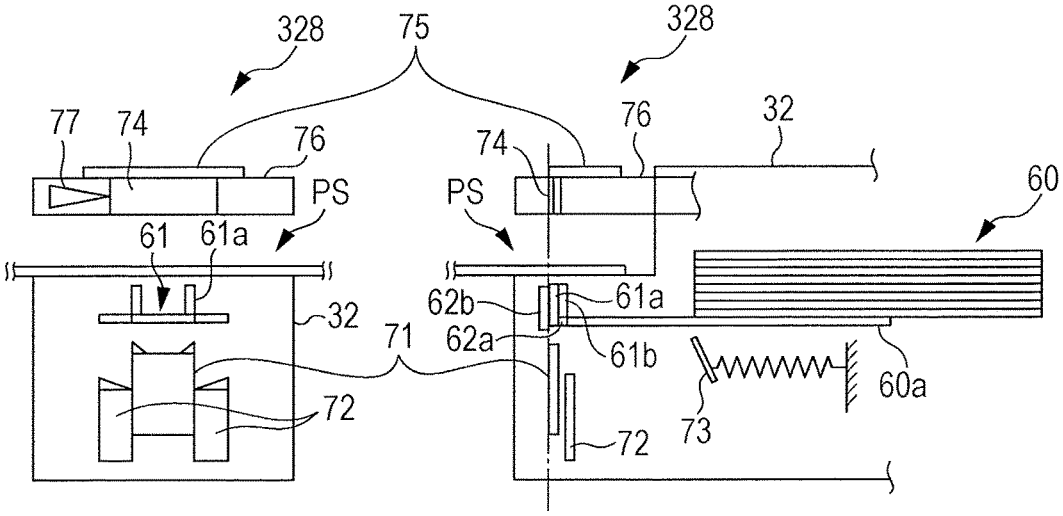
FIG. 15 illustrates the operation of the components in the fifth step of the stapling operation performed by the stapler.

Subsequently, when the steps shown in FIGS. 12 to 14 are repeated again, the first two staples 61*a* and 61*b* are bent this time, and the leading staple 61*a* is brought into abutment with the second stopper 62*b*, as shown in FIG. 15.

The sensor 53 shown in FIG. 4 is configured to detect that the bent leading staple 61*a* of the staple plate 60*a* is in abutment with the second stopper 62*b*. When the sensor 53 detects this state, the actual stapling operation for binding a sheet bundle becomes executable.

Figure 13:
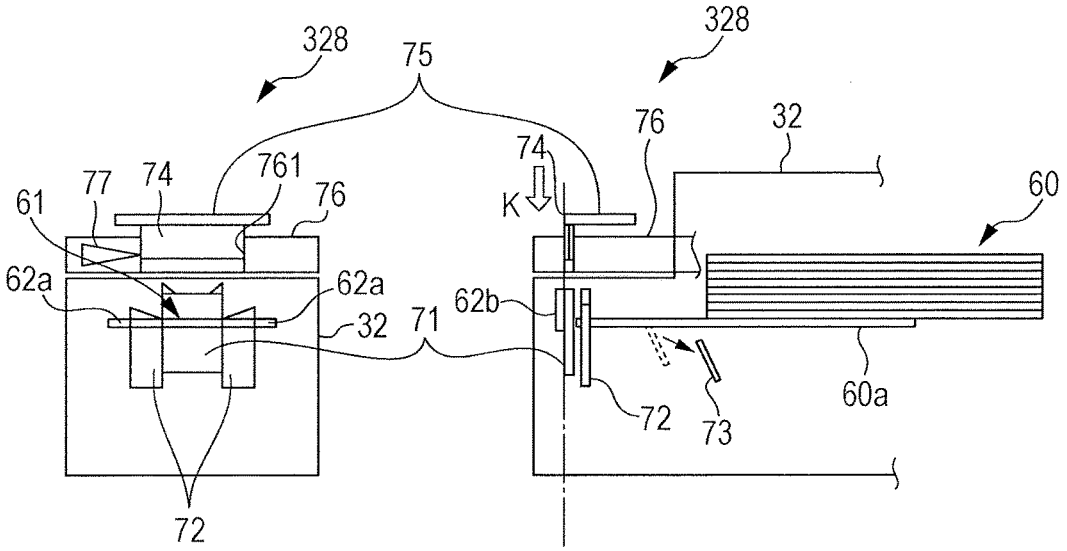
FIG. 13 illustrates the operation of the components in a fourth step of the stapling operation performed by the stapler.

The blank operation shown in FIGS. 12 to 14 is repeated for a maximum of 13 times. This is because the feeding of the staple plate 60*a* by the plate spring 73 may possibly fail. If the sensor 53 does not detect the presence of the leading staple 61*a* even after repeating the steps in FIGS. 12 to 14 for 13 times, an error process is executed.

FIG. 15 illustrates a state where the actual stapling operation is being started.

In this state, the first two staples 61*a* and 61*b* of the staple plate 60*a* are bent, and the leading staple 61*a* is in abutment with the second stopper 62*b*. Furthermore, in FIG. 15, a sheet bundle PS to be bound using a staple is also shown.

Figure 16:
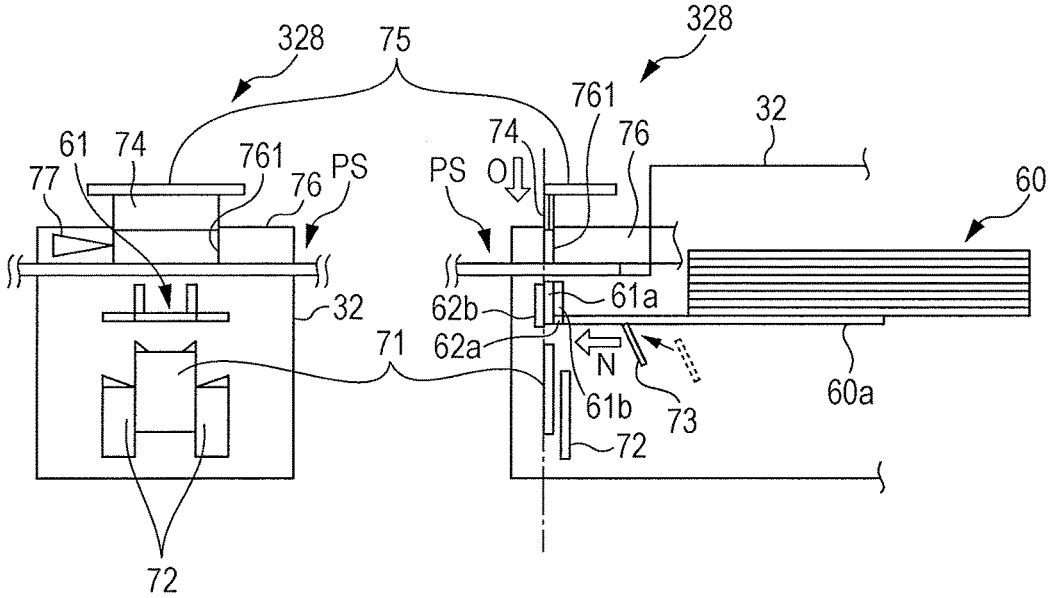
FIG. 16 illustrates the operation of the components in a sixth step of the stapling operation performed by the stapler.

Next, referring to FIG. 16, the plate spring 73 pushes the staple plate 60*a* in a direction indicated by an arrow N so as to press the staple plate 60*a* against the staple stopper 62. Moreover, the upper member 76 descends in a direction indicated by an arrow O so as to press onto the sheet bundle PS from above. In this state, the recess 761 is formed.

Figure 17:
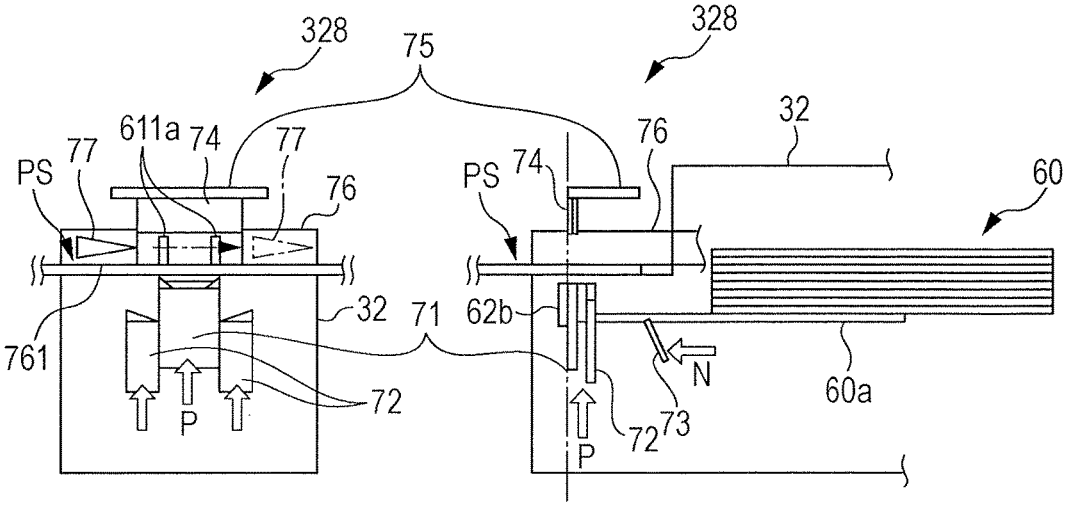
FIG. 17 illustrates the operation of the components in a seventh step of the stapling operation performed by the stapler.

Subsequently, referring to FIG. 17, the staple lifting member 71 ascends in a direction indicated by an arrow P so as to pierce the sheet bundle PS with the leading staple 61*a*. Moreover, the staple bending member 72 also ascends so as to bend upward the opposite ends of a leading linearly-shaped staple 61, which is two staples behind the leading staple 61*a*.

Then, the cutter 77 is activated so that ends 611*a* of the staple 61*a* that have pierced the sheet bundle PS are cut off. After the cutting process, the cutter 77 returns to its initial position. The ends 611*a* cut off from the staple 61*a* by the cutter 77 are accommodated within the accommodation section 329 of the stapler 32 shown in FIG. 1 and are ultimately transferred to the staple collecting box 37 so as to be discarded.

In this state, the sheet bundle PS is pressed from above by the upper member 76. On the other hand, the cutter 77 is supported at a fixed height relative to a lower surface of the upper member 76 pressing against the sheet bundle PS. The cutter 77 cuts off the ends 611*a* from the staple 61*a* at this fixed height. Therefore, the cutter 77 cuts off the ends 611*a* from the staple 61*a* such that the remaining length of the segments of the staple 61*a* piercing the sheet bundle PS and extending upward from the sheet bundle PS is always fixed after the cutting process, regardless of the thickness of the sheet bundle PS. With this cutter 77, the stapler 32 is capable of handling a thick sheet bundle PS and is also capable of binding a thin sheet bundle PS by using a staple without the staple being too long since the ends are cut off by the cutter 77.

Figure 18:
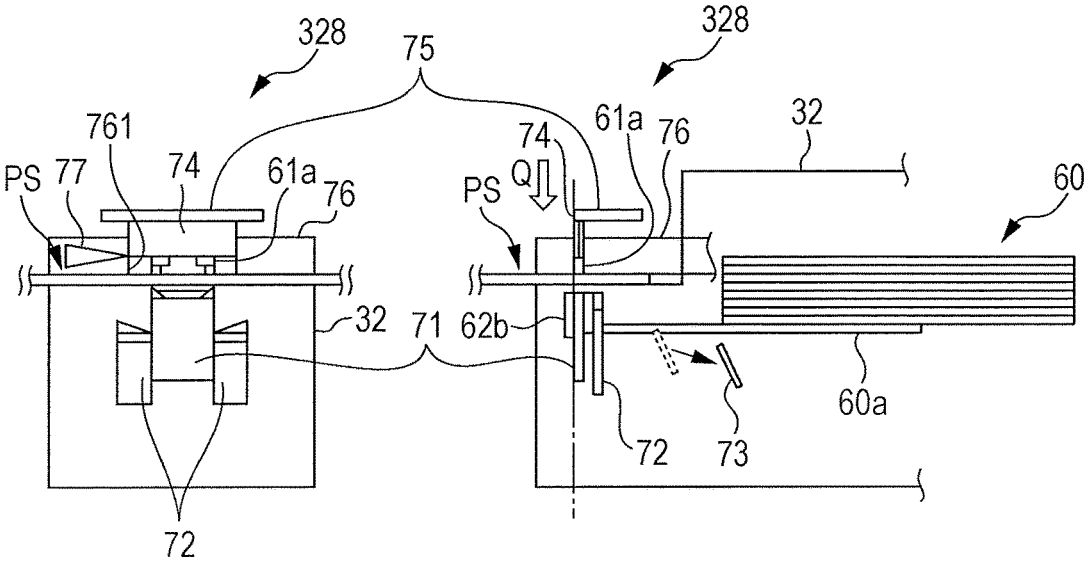
FIG. 18 illustrates the operation of the components in an eighth step of the stapling operation performed by the stapler.

Subsequently, referring to FIG. 18, the pressing member 75 descends in a direction indicated by an arrow Q, and the staple bending member 74 is pushed into the recess 761, so that the opposite ends of the staple 61*a* are bent inward. The recess 761 is slightly inclined so as to prevent the inwardly-bent opposite ends of the staple 61*a* from hitting against each other.

Figure 19:
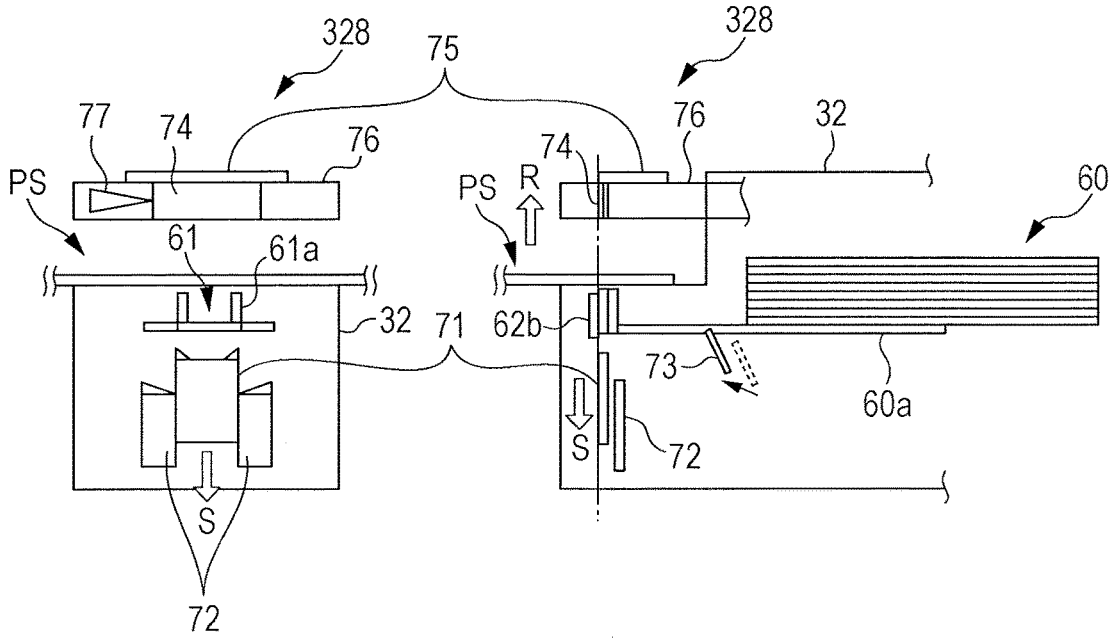
FIG. 19 illustrates the operation of the components in a ninth step of the stapling operation performed by the stapler.

Subsequently, referring to FIG. 19, the upper member 76 ascends in a direction indicated by an arrow R. In accordance with this ascending of the upper member 76, the staple bending member 74 and the pressing member 75 also ascend together with the upper member 76. Moreover, the staple lifting member 71 and the staple bending member 72 descend in a direction indicated by an arrow S. The staple plate 60*a* is pushed by the plate spring 73 so that the next leading staple is brought into abutment with the second stopper 62*b*.

Subsequently, the sheet bundle PS bound by the staple is output outside the post-processing device 30 in a manner described above with reference to FIG. 2.

The steps shown in FIGS. 15 to 19 described above are repeated so that sheet bundles PS bound by the staples 61 are sequentially formed. The series of operation as a group of the steps described above with reference to FIGS. 15 to 19 corresponds to an example of a series of operation.

The other sensor 54 shown in FIG. 4 is configured to detect that the number of remaining staples 61 has become small as a result of consumption of the staples 61 in the above-described manner. When the number of staples 61 becomes small, an attention message is given to the user.

Figure 20:
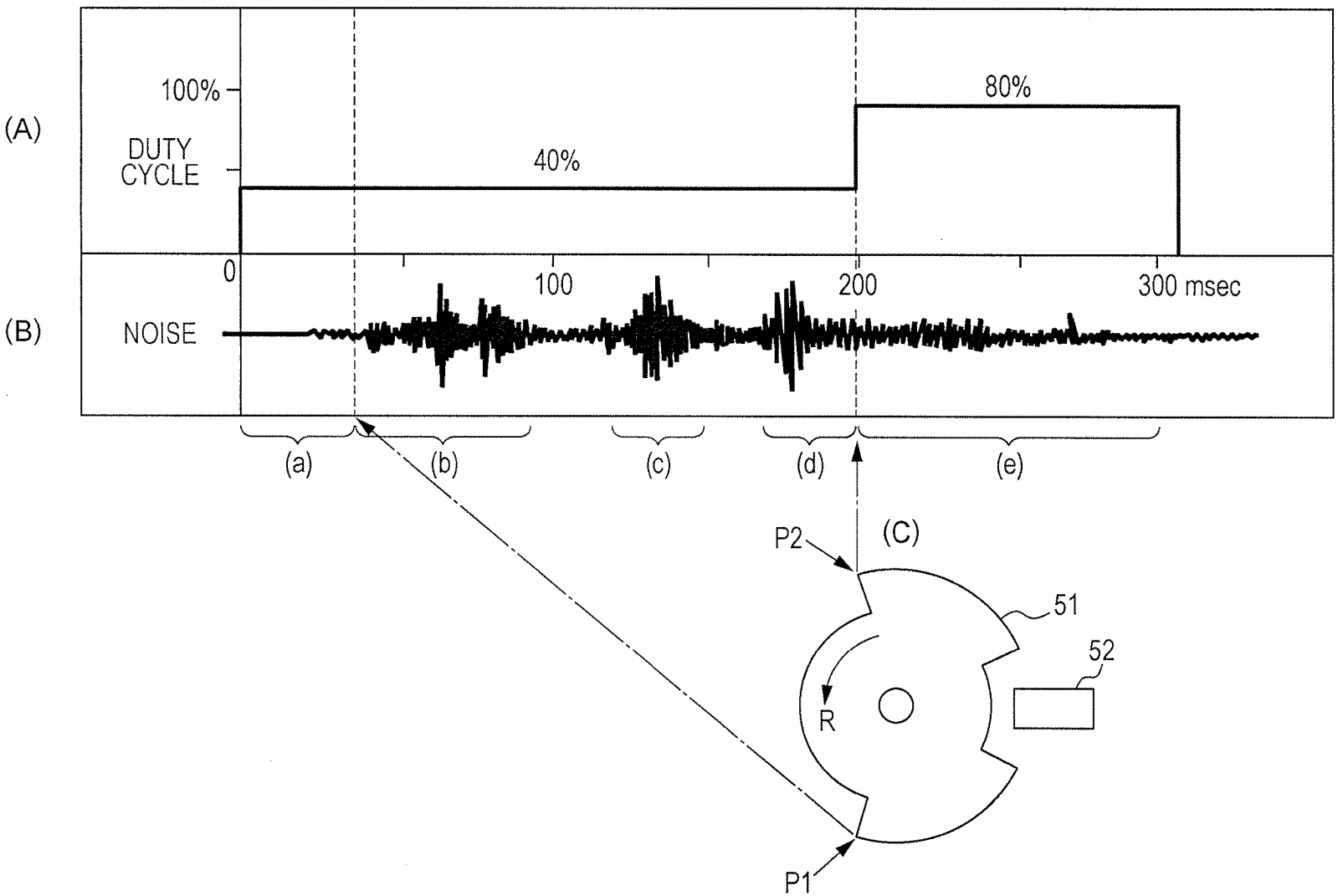
FIG. 20 illustrates an example of a duty cycle of electric power supplied to a DC motor and a temporal change in noise waveform during the stapling operation.

FIG. 20 illustrates an example of a duty cycle of electric power supplied to the DC motor and a temporal change in noise waveform during the stapling operation.

The duty cycle shown in part (A) of FIG. 20 will be described in detail later.

The noise waveform shown in part (B) of FIG. 20 is a waveform obtained when the duty cycle of the electric power supplied to the DC motor is fixed at 100% throughout the entire stapling operation.

In FIG. 20, (a) denotes an activation process, (b) denotes a clamping process, (c) denotes a staple-leg cutting process, (d) denotes a clinching process, and (e) denotes a recovery process. The activation process (a) is a run-up process from a point when the operation starts from the initial position to a point when the subsequent clamping process begins. The operation of the stapler 32 in this activation process corresponds to an example of activation operation. The clamping process (b) is a process for piercing a sheet bundle with a staple. The operation of the stapler 32 in this clamping process corresponds to an example of piercing operation. As described above, in this clamping process, bending of a staple on standby is also performed. The staple-leg cutting process (c) is a process for cutting off the ends of the staple that have pierced the sheet bundle. The clinching process (d) is a process for bending the staple and binding the sheet bundle after cutting off excess ends that have pierced the sheet bundle. The operation of the stapler 32 in this clinching process corresponds to an example of bending operation. The final recovery process (e) is a process for ending the series of stapling operation and returning to the initial position.

It is apparent from part (B) in FIG. 20 that loud noise is generated in the clamping process (b), the staple-leg cutting process (c), and the clinching process (d). It is known that, when the duty cycle of the electric power supplied to the DC motor serving as a drive source that executes these processes (a) to (e) is reduced, the operation slows down and noise is thus reduced. The operation of the stapler 32 in the recovery process (e) corresponds to an example of recovery operation. As described above, the entire operation of the stapler 32 from the activation process (a) to the recovery process (e) corresponds to an example of a series of operation.

As described above with reference to FIGS. 6A and 6B, the light blocking plate 51 shown in part (C) of FIG. 20 is detected by the MP sensor 52.

Part (C) of FIG. 20 illustrates the positional relationship between the light blocking plate 51 and the MP sensor 52 when the components constituting the stapler 32 are located at their initial positions. When the stapling operation starts, the DC motor rotates, causing the light blocking plate 51 to also rotate in a direction indicated by an arrow R. In this exemplary embodiment, while the series of processes (a) to (e) is being executed, the light blocking plate 51 starts rotating from the initial position shown in part (C) of FIG. 20, makes one rotation, and then returns to this initial position again. The timing at which a point P1 is detected by the MP sensor 52 is the timing for starting the clamping process (b), and the timing at which a point P2 is detected by the MP sensor 52 is the timing for ending the clinching process (d). The timing for starting the clamping process (b) corresponds to an example of a second timing, and the timing for ending the clinching process (d) corresponds to an example of a first timing. However, even when the duty cycle of the electric power supplied to the DC motor is changed, there is a time lag because the DC motor does not respond immediately. Therefore, the shape of the light blocking plate 51 and the orientation thereof in the rotational direction are set such that the MP sensor 52 detects the light blocking plate 51 at an earlier timing by an amount equivalent to the time lag. A detailed description with regard to this time lag will be omitted.

Figure 21:
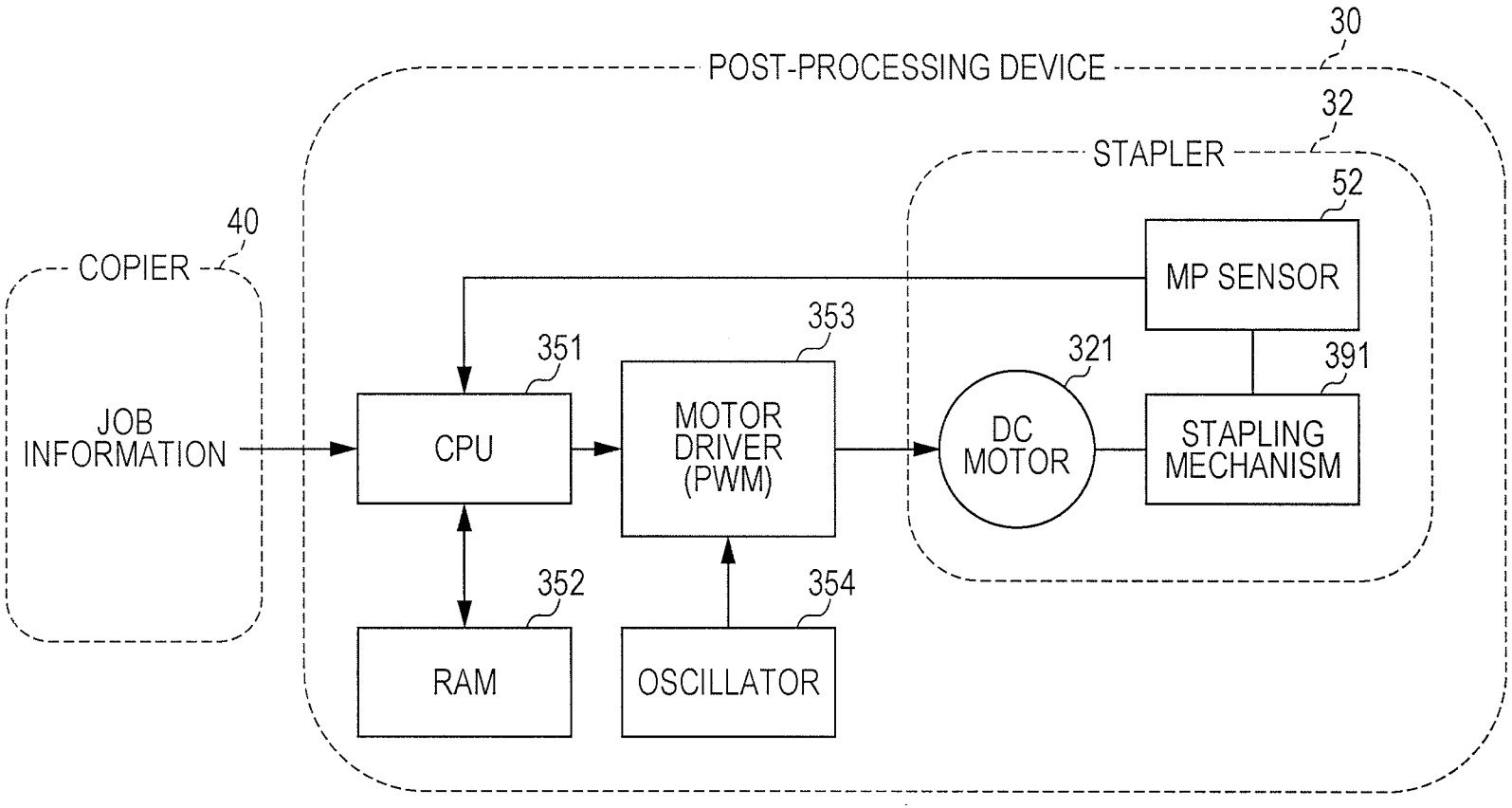
FIG. 21 is a block diagram of a control circuit that controls the operation of the stapler in the post-processing device.

FIG. 21 is a block diagram of a control circuit that controls the operation of the stapler 32 in the post-processing device 30.

In FIG. 21, a central processing unit (CPU) 351, a random access memory (RAM) 352, a motor driver 353, and an oscillator 354 are shown. These components are some of components within a sheet processing controller 38 shown in FIG. 1. Together with the RAM 352 and a program executed by the CPU 351, the CPU 351 corresponds to an example of a supply power controller. Moreover, together with the RAM 352 and the program executed by the CPU 351, the CPU 351 also corresponds to an example of a unit-of-processing manager.

Furthermore, the DC motor 321, a stapling mechanism 391 constituted of the various types of components described above, and the MP sensor 52 are shown in FIG. 21 as components of the stapler 32.

When the post-processing device 30 is turned on, various kinds of data, which will be described later, stored within a nonvolatile memory (not shown) are transferred to the RAM 352, and a stapling-operation control program to be executed by the CPU 351 is also loaded into the RAM 352. When there is a command for performing a process in the post-processing device 30, the CPU 351 receives the aforementioned job information from the connected copier 40. This job information includes information indicating, for example, the type of sheets constituting a sheet bundle to be stapled in the post-processing device 30, the number of sheets per bundle, and the number of sheet bundles, as well as information indicating which one of the duplex printing mode and the simplex printing mode has been performed. Moreover, the CPU 351 also receives an output signal from the MP sensor 52. Based on this output signal, the CPU 351 recognizes that the stapler 32 is in its initial state and that the stapler 32 is at a timing for switching from the clinching process (d) to the recovery process (e) shown in FIG. 20.

The motor driver 353 generates pulse-width-modulation (PWM) power with respect to a duty cycle in response to a command received from the CPU 351. The oscillator 354 generates a clock signal to be used by the motor driver 353 for generating the PWM power. The motor driver 353 and the oscillator 354 correspond to an example of a power supply unit.

The term "PWM" refers to a technology for modulating electric power into a periodical pulse-shaped waveform. The pulse height of the modulated waveform is equivalent to the rated voltage of the DC motor 321. The ratio of the pulse width to the pulse period in the modulated waveform is the ratio of the effective output to the rated output. This ratio is called a duty cycle (i.e., an output ratio) of the PWM power. By adjusting this duty cycle, the effective output of the PWM power is adjusted between zero and the rated power. The PWM in this exemplary embodiment corresponds to an example of interruption of electric power supplied to the direct-current motor, and the duty cycle corresponds to an example of a connection-time ratio when the electric power is interrupted.

The PWM power generated at the motor driver 353 is supplied to the DC motor 321. The DC motor 321 rotates in accordance with the supplied PWM power. Although the DC motor 321 rotates substantially at a rotation speed according to the duty cycle of the PWM power supplied to the DC motor 321, the rotation speed greatly varies in accordance with individual differences among staplers 32 or the type and the number of sheets to be bound together. Thus, the duty cycle and the rotation speed do not always have a one-to-one relationship.

FIG. 22 illustrates a correspondence relationship between modes and tables. The contents are loaded into the RAM 352 shown in FIG. 21 prior to the operation performed in the post-processing device 30.

In the post-processing device 30, duty control varies in accordance with whether sheets constituting a sheet bundle have been processed in the duplex printing mode or the simplex printing mode. In the post-processing device 30, the CPU 351 recognizes the process (i.e., the simplex printing mode or the duplex printing mode) performed on the sheets constituting the sheet bundle based on job information transmitted from the copier 40.

FIG. 22 shows that a table 1 is applied if mode information transmitted from the copier 40 to the post-processing device 30 indicates the simplex printing mode and that a table 2 is applied if the mode information indicates the duplex printing mode.

When the job information is transmitted from the copier 40, the CPU 351 refers to a table shown in FIG. 23 by using information included in the job information, which indicates the type of sheets and the number of sheets per bundle, so as to determine whether which one of groups A, B, and C the sheet bundle that is to undergo stapling operation belongs to.

FIG. 23 illustrates a group table that classifies sheet bundles into groups based on the sheet type and the number of sheets.

In the group table shown, the number of sheets (i.e., the number of staples) constituting each sheet bundle to be stapled is classified into five groups. With regard to the type of sheets, it is assumed that there are six types of sheets, namely, "thin paper", "plain paper 1", "plain paper 2", "thick paper", "coated paper", and "thick sheet 2" in this order from the thinner to the thicker. This group table shows which type of sheets belongs to which group by binding how many sheets.

Although information indicating the type of sheets used in the current printing operation, the number of sheets per bundle, and the number of bundles is included in the job information input to the post-processing device 30 from the connected copier 40, the post-processing device 30 refers to the group table by using the information indicating the sheet type and the number of sheets per bundle from among these pieces of information, so as to determine a sheet-bundle group.

In this group table shown, sheet bundles to be bound are classified into three groups, namely, the group A, the group B, and the group C, in accordance with the type and the number of sheets. With regard to load necessary for performing the stapling operation on a sheet bundle, low load is set for the group A, intermediate load is set for the group B, and high load is set for the group C. For example, with regard to plain paper 1 having a relatively small thickness, a bundle constituted of 2 to 20 sheets belongs to the group A, and a bundle constituted of 21 to 100 sheets belongs to the group B. A bundle constituted of 101 or more sheets belongs to the group C. With regard to coated paper having a relatively large thickness, a bundle belongs to the group C even when it is constituted of 2 sheets.

The information shown in FIG. 23 is stored in a nonvolatile memory (not shown) of the post-processing device 30 and is loaded into the RAM 352 shown in FIG. 21 prior to operation.

FIGS. 24A and 24B illustrate the contents of the two tables 1 and 2 shown in FIG. 22. The information shown in FIGS. 24A and 24B is also stored in the nonvolatile memory (not shown) and is loaded into the RAM 352 shown in FIG. 21 prior to operation of the post-processing device 30.

FIGS. 24A and 24B illustrate the duty cycle at the time of start of the stapling operation and the duty cycle at the time of recovery for each of the groups A, B, and C with respect to the tables (i.e., the tables 1 and 2) set in correspondence with the printing modes (i.e., the simplex printing mode and the duplex printing mode).

The start duty cycle shown in FIGS. 24A and 24B varies between the tables. In the simplex printing mode corresponding to the table 1 shown in FIG. 24A, the duty cycle is set to be lower than that in the duplex printing mode corresponding to the table 2 shown in FIG. 24B. This is because a staple tends to pierce a sheet bundle more readily in simplex printing than in duplex printing. In addition, in simplex printing, while the stability of the stapling operation is not impaired even by reducing the stapling speed relative to that in duplex printing, the operation is performed more quietly by reducing the speed. Moreover, in the same table, the start duty cycle and the recovery duty cycle increase for sheet bundles belonging to higher load groups. The processing speed tends to increase with increasing duty cycle, resulting in louder noise. On the other hand, for sheet bundles belonging to high load groups, the operation may possibly become unstable unless driving is performed using a large driving force by increasing the duty cycle. The start duty cycle and the recovery duty cycle are set to duty cycles that comply with these conflicting demands at a high level. Furthermore, in any one of the groups in either one of the tables, the recovery duty cycle is set to be higher than the start duty cycle. The reason for this is as follows. Because the maximum permissible time for one cycle of stapling operation is set in view of productivity, noise reduction is achieved in a process that generates loud operating noise by reducing the processing speed by reducing the duty cycle, whereas the processing speed is increased in a process that generates low operating noise by increasing the duty cycle so as to complete the operation within the maximum permissible time. Furthermore, in the recovery process, the load becomes large since many of the various components constituting the stapler 32 return to their initial positions at substantially the same time. Thus, if the duty cycle is low, the operation tends to become unstable. This is another one of the reasons for setting the recovery duty cycle higher than the start duty cycle.

FIGS. 25A and 25B each illustrate a working area within the RAM 352.

In the working area shown in FIG. 25A, the start duty cycle and the recovery duty cycle are stored. The start duty cycle and the recovery duty cycle stored in this working area are a start duty cycle and a recovery duty cycle applied to the current job and are selected from the start duty cycles and the recovery duty cycles shown in FIGS. 24A and 24B. The start duty cycle and the recovery duty cycle are stored into the working area shown in FIG. 25A every time a job is updated, and are basically not re-stored therein even when there are successive sheet bundles within a single job. However, as will be described later, the start duty cycle is sometimes renewed even within a single job.

For example, it is assumed that the current job relates to a sheet bundle belonging to the group A in the table (i.e., simplex printing mode) shown in FIG. 24A, and that duty cycles in the group A in the table (i.e., a start duty cycle of 40% and a recovery duty cycle of 80%) are selected and stored into the working area in FIG. 25A.

In the working area shown in FIG. 25B, a sensor flag indicating whether or not the point P2 (see FIG. 20) of the light blocking plate 51, that is, the boundary between the clinching process (d) and the recovery process (e), is detected by the MP sensor 52.

Figure 26:
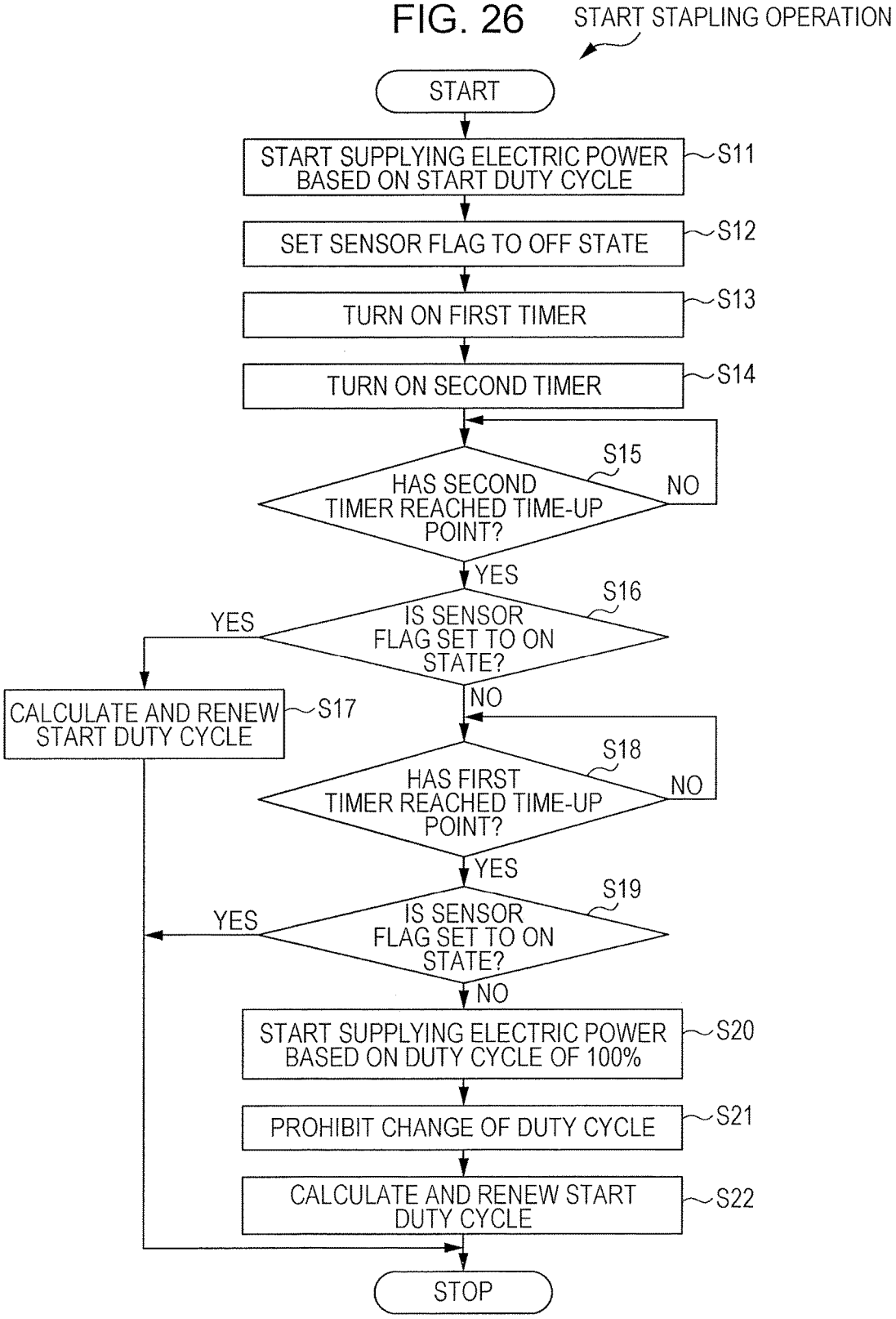
FIG. 26 is a flowchart illustrating a process performed based on one of programs executed by a CPU shown in FIG. 21 when the stapling operation starts.

FIG. 26 is a flowchart illustrating a process performed based on one of programs executed by the CPU 351 shown in FIG. 21 when the stapling operation starts.

Figure 27:
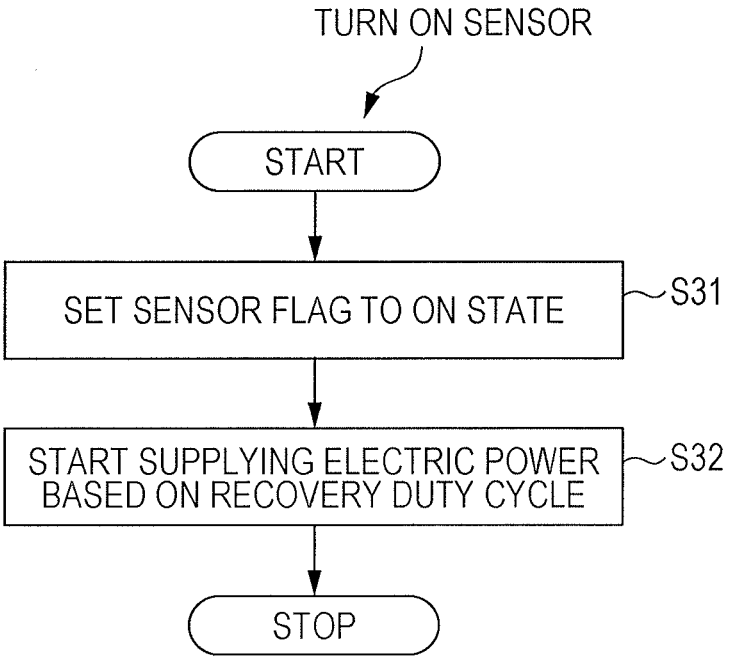
FIG. 27 is a flowchart illustrating a process performed based on one of the programs executed by the CPU shown in FIG. 21 when the boundary between a clinching process and a recovery process is detected by the MP sensor.

FIG. 27 is a flowchart illustrating a process performed based on one of the programs executed by the CPU 351 shown in FIG. 21 when the boundary between the clinching process and the recovery process is detected by the MP sensor 52.

Referring to FIG. 26, when the stapling operation starts, supply of electric power to the DC motor 321 (see FIG. 21) based on a start duty cycle (i.e., 40%) begins by referring to the start duty cycle stored in the working area shown in FIG. 25A. Furthermore, at this timing, the sensor flag (see FIG. 25B) is set to an off state in step S12, and a first timer and a second timer are turned on in steps S13 and S14, respectively. The first timer is set so as to reach a predetermined time-up point at a timing at which it is no longer waitable for the sensor flag to be set to an on state. In this case, the time-up period of the first timer is set to, for example, 300 milliseconds. The second timer is set so as to reach a predetermined time-up point at the latest timing before which it is not desired that the sensor flag is set to an on state yet. The time-up period of the second timer is set to, for example, 180 milliseconds. The first timer and the second timer correspond to examples of a first timekeeper and a second timekeeper, respectively.

Alternatively, the time-up periods of the first timer and the second timer may be uniformly set without being dependent on the tables 1 and 2 shown in FIGS. 24A and 24B or the groups A, B, and C, or one of or both of the first timer and the second timer may be set individually in accordance with the tables 1 and 2 or the groups A, B, and C.

Before proceeding with the description with reference to FIG. 26, a description with reference to the flowchart shown in FIG. 27 will be provided first.

When the stapling operation starts, the sensor flag (see FIG. 25B) is temporarily set to an off state in step S12, as described above. Subsequently, at some point, the MP sensor 52 detects that the point P2 shown in FIG. 20, that is, the boundary between the clinching process and the recovery process, is reached. At this timing, the process shown in FIG. 27 starts.

First, in step S31, the sensor flag (see FIG. 25B) is set to an on state.

Subsequently, by referring to the recovery duty cycle (i.e., 80%) stored in the working area shown in FIG. 25A, the duty cycle of the electric power supplied to the DC motor 321 (see FIG. 21) is changed from the previous start duty cycle (40%) to the recovery duty cycle (80%). This is because there is less noise in the recovery process as shown in FIG. 20, and a problem in recovering the operation to high speed by increasing the duty cycle is small.

The maximum time permitted in one cycle of stapling operation is set in advance. It is necessary to complete a series of stapling operation within this permitted maximum time. In this exemplary embodiment, the duty cycle is changed before and after the recovery process such that noise is suppressed by reducing the duty cycle before the recovery process and that the operation is recovered to high speed by increasing the duty cycle in the recovery process for the amount of time taken due to the reduced duty cycle.

The time taken for executing the processes in the series of stapling operation is not always consistent as expected and varies depending on various factors, such as temperature and humidity, a variation in paper quality, and the printing contents. If the timing for changing the duty cycle is set based on the time measured from the start of the operation, the time-up timing may sometimes deviate from the actual timing between the clinching process and the recovery process. If the time-up point is reached at a timing earlier than the actual timing and the duty cycle is changed to 80%, there is a possibility that loud noise may be generated due to the clinching process being not completed yet.

Furthermore, as described above, since it is necessary to simultaneously set the various components of the stapler 32 back to their initial states in the recovery process, large load is applied in order to execute this recovery process. Therefore, if the time-up timing by the timer is later than the actual switching timing between the clinching process and the recovery process, the duty cycle remains at a lower level even after the recovery process begins, causing the recovery process to become unstable or the operation to stop due to an inability to withstand the load. Once the operation stops, even larger load is applied for resuming the operation, causing the operation to be slow even by increasing the duty cycle after the stoppage. Thus, there is a possibility that the stapling operation may be not completed before the predetermined permitted maximum time or that resuming of the operation may become impossible.

In this exemplary embodiment, the MP sensor 52 detects the light blocking plate 51 rotating based on the rotation of the DC motor 321 so as to detect the passing timing of the boundary between the clinching process and the recovery process, thereby changing the duty cycle at a proper timing without causing the aforementioned problem.

The description will proceed below by referring back to FIG. 26.

Step S15 is a step for waiting for the second timer to reach the predetermined time-up point. The reaching of the time-up point by the second timer corresponds to an example of reaching of a second time point measured by the second timekeeper. When the second timer reaches the time-up point, the process proceeds to step S16 which is a step for referring to the working area shown in FIG. 25B and determining whether or not the sensor flag is in an on state. The second timer is set so as to reach the time-up point at the latest timing before which it is not desired that the sensor flag is set to an on state yet prior to this time-up point. As described above, in this exemplary embodiment, the time-up period of the second timer is set to, for example, 180 milliseconds. If it is determined in step S16 that the sensor flag is already set to an on state when the second timer reaches the time-up point, a duty cycle smaller than the current start duty cycle is measured for setting the sensor flag to an on state at a timing slightly later than the time-up point of the second timer, and the start duty cycle shown in FIG. 25A is renewed to the calculated duty cycle in step S17. Thus, if the next sheet bundle to be stapled belongs to the same job as the sheet bundle currently undergoing the stapling operation, the renewed start duty cycle is employed in the subsequent stapling operation. Consequently, operating noise may be further suppressed in the subsequent stapling operation.

Even when the sensor flag is in an on state before the second timer reaches the time-up point, the duty cycle of the electric power supplied to the DC motor 321 is changed to the recovery duty cycle at the timing at which the sensor flag is set to an on state (see step S32 in FIG. 27).

When it is determined in step S16 that the sensor flag is still in an off state when the second timer reaches the time-up point, the process proceeds to step S18 which is a step for waiting for the first timer to reach the time-up point. Similar to the case of the second timer described above, the reaching of the time-up point by the first timer corresponds to an example of reaching of a first time point measured by the first timekeeper. When the first timer reaches the time-up point, it is determined again whether or not the sensor flag (FIG. 25B) is in an on state in step S19.

The first timer is set so as to reach the time-up point at a timing at which it is no longer waitable for the sensor flag to be set to an on state. In this exemplary embodiment, as described above, the time-up period is set to 300 milliseconds. If the sensor flag is set to an on state before the first timer reaches the time-up point, there is no problem in the operation being performed. Therefore, the process in FIG. 26 ends.

If the sensor flag is still in an off state when the first timer reaches the time-up point, the DC motor 321 is supplied with electric power with a duty cycle of 100% so that the operation is executed at maximum speed in step S20. Then, a further change of the duty cycle is prohibited in the current stapling operation in step S21. This is to prevent the duty cycle from being changed again in step S32 in FIG. 27 when the sensor is turned on after the duty cycle is changed to 100% in step S20.

Furthermore, in step S22, a duty cycle that causes the sensor flag to be in an on state before the first timer reaches the time-up point is calculated, and the start duty cycle shown in FIG. 25A is renewed to the calculated duty cycle. Thus, if the next sheet bundle to be stapled belongs to the same job as the current sheet bundle, proper operation is expected to be performed on the next sheet bundle even though noise slightly increases. For the next sheet bundle, if the sensor flag is not in an on state when the first timer reaches the time-up point, an error process is performed, although not shown here.

Accordingly, in this exemplary embodiment, operating noise may be suppressed while complying with the maximum time permitted in one cycle of stapling operation.

Figure 28:
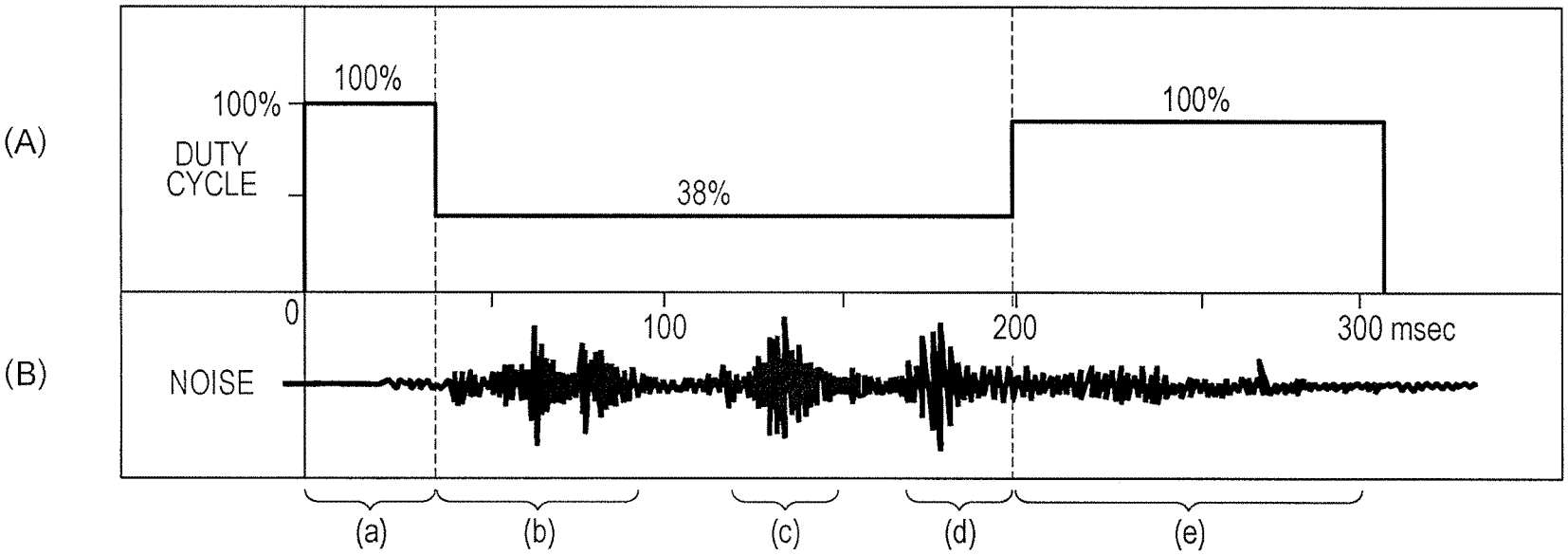
FIG. 28 illustrates a temporal change in a duty cycle of electric power supplied to the DC motor according to a first modification.

FIG. 28 illustrates a temporal change in the duty cycle of electric power supplied to the DC motor according to a first modification. Specifically, FIG. 28 corresponds to FIG. 20 in the above exemplary embodiment, and similarly illustrates a noise waveform. However, the light blocking plate 51 and the MP sensor 52 shown in part (C) of FIG. 20 are not illustrated in FIG. 28. In the first modification shown in FIG. 28, a duty cycle of 100% is applied in the activation process (a) and the recovery process (e). The timing corresponding to the boundary between the activation process (a) and the clamping process (b) is recognized based on detection of the point P1 of the light blocking plate 51 by the MP sensor 52 shown in FIG. 20.

In the first modification shown in FIG. 28, since high-speed operation is achieved by setting the duty cycle to 100% for both the recovery process (e) and the activation process (a), further noise reduction may be achieved by reducing the duty cycle to 38% in the clamping process (b), the staple-leg cutting process (c), and the clinching process (d).

In order to realize the first modification, it is necessary to change, for example, the tables in FIGS. 24A and 24B, the working area in FIG. 25A, and the flowchart in FIG. 26 in the above exemplary embodiment. However, since this is obvious, these figures and descriptions thereof will be omitted here.

Figure 29:
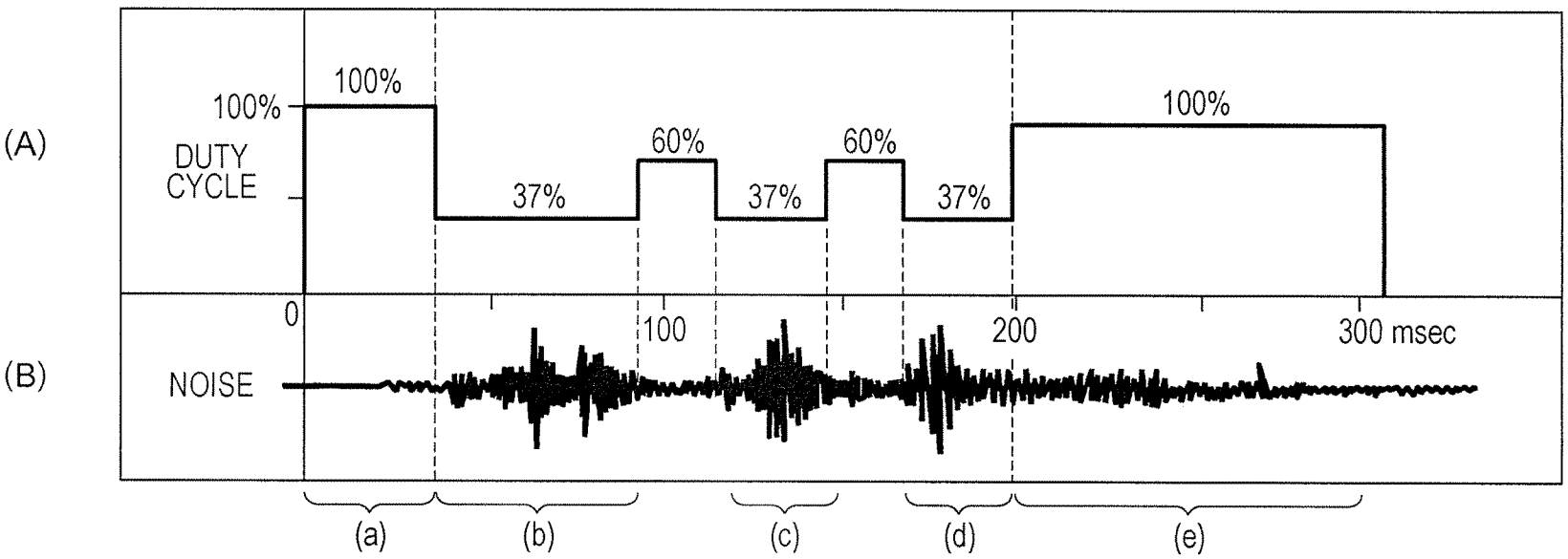
FIG. 29 illustrates a temporal change in a duty cycle of electric power supplied to the DC motor according to a second modification.

FIG. 29 illustrates a temporal change in the duty cycle of electric power supplied to the DC motor according to a second modification. The following description relates to differences from the first modification shown in FIG. 28.

In the second modification shown in FIG. 29, the duty cycle is increased to 60% twice, namely, in a time period from the end of the clamping process (b) to the start of the staple-leg cutting process (c) and in a time period from the end of the staple-leg cutting process (c) to the start of the clinching process (d). Accordingly, the operation speed is slightly increased, and the duty cycle in the clamping process (b), the staple-leg cutting process (c), and the clinching process (d) is reduced to 37% by distributing excess time generated as a result of the slight increase in the operation speed to the processes (b), (c), and (d). Consequently, further noise reduction may be achieved.

With regard to the second modification, the figures and descriptions corresponding to, for example, the tables in FIGS. 24A and 24B, the working area in FIG. 25A, and the flowchart in FIG. 26 in the above exemplary embodiment will be omitted here due to obvious reasons. Moreover, although it is necessary to change the shape of the light blocking plate 51 (see FIG. 20) in the second modification, a figure and a description thereof will be omitted here since this is also obvious. As described above, since there is a delay in the response from the DC motor 321 even by changing the duty cycle, the detection of the light blocking plate 51 by the MP sensor 52 is adjusted so as to be performed at an earlier timing in view of the delay.

Although the MP sensor 52 detects the light blocking plate 51 so as to detect a specific intermediate timing of the stapling operation, the detection of the timing may be performed based on the rotational amount of the DC motor 321 and is not limited to the combination of the light blocking plate 51 and the MP sensor 52. For example, a sensor that detects the presence or absence of a gear tooth of a gear that rotates by being driven by the DC motor 321 may be provided, such that the timing may be detected by counting the number of gear teeth passing by the position of the sensor. Alternatively, for example, a lever that moves back and forth in accordance with the rotation of the DC motor 321 may be provided, and a limit switch that is turned on and off by the movement of the lever may be provided. With this configuration, the timing may be detected by counting the number of times the limit switch is turned on and off.

Although the print system 1A constituted by connecting the post-processing device 30 to the copier 40 shown in FIG. 1 is described above as an example, an inkjet printer, for example, may be provided in place of the copier 40. The image forming principle of an image forming apparatus according to an exemplary embodiment of the present invention is not limited. Furthermore, a binding device according to an exemplary embodiment of the present invention is not limited to a type that is connectable only to an image forming device, such as a copier or a printer. For example, the binding device may be connected to a transport device that simply transports an already-printed sheet or may be connected to any type of device so long as the device is configured to transport sheets to be bound together to the binding device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding device comprising:

a sheet-bundle forming unit configured to form a sheet bundle by receiving and stacking a plurality of sheets;

a binding unit that includes a motor and that is configured to execute a series of operations including inserting opposite ends of a substantially U-shaped bent wire into the sheet bundle by utilizing a driving force from the motor, and bending the opposite ends;

a power supply unit configured to adjust electric power and supply the adjusted electric power to the motor;

a detector configured to detect, based on a rotational amount of the motor, a first timing for transitioning from a bending operation for bending the opposite ends of the wire that have pierced the sheet bundle to a recovery operation for recovering to an initial position upon completion of the bending operation;

a first timekeeper configured to measure time from a start point of the series of operations to a first time point, which is an end of a scheduled period for detecting the first timing;

a second timekeeper configured to measure time from the start point of the series of operations to a second time point, which is a start point of the schedule period and is reached prior to the first time point;

a unit-of-processing manager configured to manage a unit of processing; and a supply power controller configured to, in response to the first timing being detected by the detector before the second time point measured by the second timekeeper is reached, cause the power supply unit to adjust the electric power supplied to the motor before the first timing is reached, such that the first timing is detected by the detector when or after the second time point measured by the second timekeeper is reached in the series of operations for a second sheet bundle that is to undergo a subsequent series of operations belonging to the same unit of processing as a first sheet bundle undergoing a current series of operations, and wherein the supply power controller is configured to cause the power supply unit to increase the electric power supplied to the motor in response to the first time point measured by the first timekeeper being reached before the first timing is detected by the detector.

2. The binding device according to Claim 1, wherein the motor is a direct-current motor, wherein the power supply unit is configured to interrupt the electric power supplied to the direct-current motor such that a connection-time ratio when the electric power is interrupted is adjustable, and wherein the supply power controller is configured to cause the power supply unit to change the ratio of the electric power supplied to the direct-current motor.

3. An image forming apparatus comprising:

the binding device according to claim 1, wherein the image forming apparatus is configured to form images onto sheets and transport the sheets to the binding device, and wherein the binding device is configured to form a bundle of the transported sheets and bind the bundle by performing the series of operations.

4. A binding device comprising:

a sheet-bundle forming unit configured to form a sheet bundle by receiving and stacking a plurality of sheets:

a binding unit that includes a motor and that is configured to execute a series of operations including inserting opposite ends of a substantially U-shaped bent wire into the sheet bundle by utilizing a driving force from the motor, and bending the opposite ends;

a power supply unit configured to adjust electric power and supply the adjusted electric power to the motor;

a detector configured to detect, based on a rotational amount of the motor, a first timing for transitioning from a bending operation for bending the opposite ends of the wire that have pierced the sheet bundle to a recovery operation for recovering to an initial position upon completion of the bending operation;

a first timekeeper configured to measure time from a start point of the series of operations to a first time point, which is an end point of a scheduled period for detecting the first timing a unit-of-processing manager configured to manage a unit of processing; and a supply power controller configured to, in response to the first time point measured by the first timekeeper being reached before the first timing is detected by the detector, cause the power supply unit to adjust the electric power supplied to the motor before the first timing is reached, such that the first timing is detected by the detector prior to reaching of the first time point measured by the first timekeeper in the series of operations for a second sheet bundle that is to undergo a subsequent series of operations belonging to the same unit of processing as a first sheet bundle undergoing a current series of operations, wherein the supply power controller is configured to cause the power supply unit to increase the electric power supplied to the motor in response to the first time point measured by the first timekeeper being reached before the first timing is detected by the detector, wherein the binding device further comprises:

a second timekeeper configured to measure time from the start point of the series of operations to a second time point that is reached prior to the first time point, and wherein the supply power controller is configured to, in response to the first timing being detected by the detector before the second time point measured by the second timekeeper is reached, cause the power supply unit to adjust the electric power supplied to the motor before the first timing is reached, such that the first timing is detected by the detector when or after the second time point measured by the second timekeeper is reached in the series of operations for a second sheet bundle that is to undergo a subsequent series of operations belonging to the same unit of processing as a first sheet bundle undergoing a current series of operations.

5. A binding device comprising:

a sheet-bundle forming unit configured to form a sheet bundle by receiving and stacking a plurality of sheets;

a binding unit that includes a motor and that is configured to execute a series of operations including inserting opposite ends of a substantially U-shaped bent wire into the sheet bundle by utilizing a driving force from the motor, and bending the opposite ends;

a power supply unit configured to adjust electric power and supply the adjusted electric power to the motor;

a detector configured to detect, based on a rotational amount of the motor, a first timing for transitioning from a bending operation for bending the opposite ends of the wire that have pierced the sheet bundle to a recovery operation for recovering to an initial position upon completion of the bending operation;

a first timekeeper configured to measure time from a start point of the series of operations to a first time point, which is an end point of a scheduled period for detecting the first timing;

a unit of processing manager configured to manage a unit of processing; and a supply power controller configured to, in response to the first time point measured by the first timekeeper being reached before the first timing is detected by the detector, cause the power supply unit to adjust the electric power supplied to the motor before the first timing is reached, such that the first timing is detected by the detector prior to reaching of the first time point measured by the first timekeeper in the series of operations for a second sheet bundle that is to undergo a subsequent series of operations belonging to the same unit of processing as a first sheet bundle undergoing a current series of operations, wherein the supply power controller is configured to cause the power supply unit to increase the electric power supplied to the motor in response to the first time point measured by the first timekeeper being reached before the first timing is detected by the detector, wherein the detector is configured to further detect a second timing in addition to the first timing, the second timing being a timing at which a transition is made from an activation operation starting from the initial position to a piercing operation for piercing the wire through the sheet bundle, the piercing operation continuing from the activation operation, and wherein the supply power controller is configured to cause the power supply unit to reduce the electric power supplied to the motor at the second timing detected by the detector.

6. The binding device according to claim 5, wherein the detector is further configured to detect, in addition to the first timing and the second timing, at least one third timing between the first timing and the second timing, and wherein the supply power controller is configured to cause the power supply unit to change the electric power supplied to the motor at the third timing detected by the detector such that, if the same electric power is continuously supplied before and after the third timing, a supplied electric power corresponding to relatively louder operating noise caused by the series of operations and a supplied electric power corresponding to relatively quieter operating noise caused by the series of operations are respectively reduced and increased with the third timing as a boundary point.

* * * * *